US010648303B2

(12) United States Patent
Romer et al.

(10) Patent No.: US 10,648,303 B2
(45) Date of Patent: May 12, 2020

(54) WIRELINE-DEPLOYED SOLID STATE PUMP FOR REMOVING FLUIDS FROM A SUBTERRANEAN WELL

(71) Applicant: ExxonMobil Upstream Research Company, Spring, TX (US)

(72) Inventors: Michael C. Romer, The Woodlands, TX (US); Randy C. Tolman, Spring, TX (US); Robert A. Frantz, III, Springfield, PA (US); Conal H. O'Neill, Livermore, CA (US)

(73) Assignee: ExxonMobil Upstream Research Company, Spring, TX (US)

( * ) Notice: Subject to any disclaimer, the term of this patent is extended or adjusted under 35 U.S.C. 154(b) by 48 days.

(21) Appl. No.: 15/965,469

(22) Filed: Apr. 27, 2018

(65) Prior Publication Data

US 2018/0313195 A1 Nov. 1, 2018

Related U.S. Application Data

(60) Provisional application No. 62/491,559, filed on Apr. 28, 2017.

(51) Int. Cl.
*E21B 43/12* (2006.01)
*E21B 34/08* (2006.01)
(Continued)

(52) U.S. Cl.
CPC ..... *E21B 43/128* (2013.01); *E21B 33/12* (2013.01); *E21B 34/08* (2013.01); *E21B 36/001* (2013.01);
(Continued)

(58) Field of Classification Search
CPC ..... E21B 43/128; E21B 36/001; E21B 34/08; E21B 33/12; E21B 47/0007; E21B 43/08;
(Continued)

(56) References Cited

U.S. PATENT DOCUMENTS 6,040,653 A 3/2000 O'Neill
6,328,102 B1 12/2001 Dean
(Continued)

FOREIGN PATENT DOCUMENTS

EP 2 077 374 A1 7/2009
GB 2 393 747 A 4/2004
(Continued)

OTHER PUBLICATIONS

Lee, Dong Gun et al., Design of a Piezoelectric-hydraulic Pump with Active Valves, Journal of Intelligent Material Systems and Structures, 2004, pp. 107-115, vol. 15, Sage Publications.

*Primary Examiner* — Brad Harcourt
(74) *Attorney, Agent, or Firm* — ExxonMobil Upstream Research Company—Law Department

(57) ABSTRACT

A system for removing wellbore liquids from a wellbore, the wellbore traversing a subterranean formation and having a tubular that extends within at least a portion of the wellbore. The system includes a positive-displacement solid state pump comprising a fluid chamber, an inlet and an outlet port, each in fluid communication with the fluid chamber, at least one solid state actuator, a first one-way check valve positioned between the inlet port and the fluid chamber, and/or a second one-way check valve positioned between the outlet port and the fluid chamber, the at least one solid state actuator configured to operate at or near its resonance frequency, the solid state pump positioned within the wellbore; and means for powering the solid state pump. A method for removing fluids from a subterranean well is also provided.

46 Claims, 17 Drawing Sheets

(51) Int. Cl.

| | |
|---|---|
| ***E21B 33/12*** | (2006.01) |
| ***E21B 47/00*** | (2012.01) |
| ***F04B 47/02*** | (2006.01) |
| ***F04B 35/04*** | (2006.01) |
| ***F04B 47/06*** | (2006.01) |
| ***F04B 53/10*** | (2006.01) |
| ***F04B 17/00*** | (2006.01) |
| ***E21B 36/00*** | (2006.01) |
| *E21B 43/08* | (2006.01) |
| *E21B 47/12* | (2012.01) |
| *F04B 51/00* | (2006.01) |
| *E21B 47/06* | (2012.01) |
| *E21B 41/00* | (2006.01) |
| *F04B 53/08* | (2006.01) |

(52) U.S. Cl.
CPC ..... *E21B 47/0007* (2013.01); *F04B 17/003* (2013.01); *F04B 35/04* (2013.01); *F04B 47/02* (2013.01); *F04B 47/06* (2013.01); *F04B 53/10* (2013.01); *E21B 41/0085* (2013.01); *E21B 43/08* (2013.01); *E21B 47/06* (2013.01); *E21B 47/065* (2013.01); *E21B 47/12* (2013.01); *F04B 51/00* (2013.01); *F04B 53/08* (2013.01)

(58) Field of Classification Search
CPC ..... E21B 47/12; E21B 47/06; E21B 47/065; E21B 41/0085; F04B 47/02; F04B 35/04; F04B 53/08; F04B 51/00; F04B 17/003; F04B 47/06; F04B 53/10
See application file for complete search history.

(56) References Cited

U.S. PATENT DOCUMENTS

| | | | | |
|---|---|---|---|---|
| 6,697,298 | B1 * | 2/2004 | Dubinsky | E21B 47/16 340/854.4 |
| 7,111,675 | B2 | 9/2006 | Zisk, Jr. | |
| 7,322,803 | B2 | 1/2008 | Vogeley | |
| 7,484,940 | B2 | 2/2009 | O'Niell | |
| 7,597,150 | B2 | 10/2009 | Clem | |
| 8,133,041 | B2 | 3/2012 | Ludlow et al. | |
| 8,196,667 | B2 | 6/2012 | Ocalan et al. | |
| 8,220,533 | B2 | 7/2012 | Longfield et al. | |
| 8,511,390 | B2 | 8/2013 | Coyle et al. | |
| 9,145,885 | B2 | 9/2015 | Bouldin et al. | |
| 2002/0197174 | A1 | 12/2002 | Howard | |
| 2003/0010491 | A1 | 1/2003 | Collette | |
| 2006/0198742 | A1 | 9/2006 | DiFoggio et al. | |
| 2008/0080991 | A1 | 4/2008 | Yuratich et al. | |
| 2009/0183879 | A1 | 7/2009 | Cox | |
| 2009/0218091 | A1 | 9/2009 | Dotson | |
| 2009/0288838 | A1 * | 11/2009 | Richards | E21B 34/063 166/374 |
| 2010/0012313 | A1 | 1/2010 | Longfield | |
| 2011/0114327 | A1 * | 5/2011 | Wilson | E21B 19/002 166/344 |
| 2012/0263606 | A1 | 10/2012 | Bouldin et al. | |
| 2013/0205888 | A1 * | 8/2013 | Teowee | E21B 47/06 73/152.46 |
| 2014/0224511 | A1 * | 8/2014 | Pessin | E21B 33/1275 166/387 |
| 2015/0060083 | A1 * | 3/2015 | Romer | E21B 23/00 166/370 |
| 2015/0130185 | A1 * | 5/2015 | Knapp | F16L 19/0231 285/330 |
| 2016/0005508 | A1 * | 1/2016 | Maclean | H01B 7/046 174/99 R |
| 2017/0328190 | A1 * | 11/2017 | Fielder, III | E21B 43/128 |

FOREIGN PATENT DOCUMENTS

| | | | |
|---|---|---|---|
| GB | 2 403 752 | A | 1/2005 |
| WO | WO 01/20126 | A2 | 3/2001 |
| WO | WO 2009/077714 | | 6/2009 |
| WO | WO 2011/079218 | A2 | 6/2011 |

* cited by examiner

WIRELINE-DEPLOYED SOLID STATE PUMP FOR REMOVING FLUIDS FROM A SUBTERRANEAN WELL

CROSS REFERENCE TO RELATED APPLICATIONS

This application claims the benefit and priority of U.S. Provisional Application Ser. No. 62/491,559 filed Apr. 28, 2017, the disclosure of which is incorporated herein by reference in its entirety. This application is also related to concurrently filed U.S. patent application Ser. No. 15/965,492, titled "Cooling Systems and Methods for Downhole Solid State Pumps", the disclosure of which is incorporated herein by reference in its entirety.

FIELD

The present disclosure is directed generally to systems and methods for artificial lift in a wellbore and more specifically to systems and methods that utilize a downhole solid state pump to remove a wellbore liquid from the wellbore.

BACKGROUND

A hydrocarbon well may be utilized to produce gaseous hydrocarbons from a subterranean formation. Often, a wellbore liquid may build up within one or more portions of the hydrocarbon well. This wellbore liquid, which may include water, condensate, and/or liquid hydrocarbons, may impede flow of the gaseous hydrocarbons from the subterranean formation to a surface region via the hydrocarbon well, thereby reducing and/or completely blocking gaseous hydrocarbon production from the hydrocarbon well.

Traditionally, plunger lift and/or rod pump systems have been utilized to provide artificial lift and to remove this wellbore liquid from the hydrocarbon well. While these systems may be effective under certain circumstances, they may not be capable of efficiently removing the wellbore liquid from long and/or deep hydrocarbon wells, from hydrocarbon wells that include one or more deviated (or nonlinear) portions (or regions), and/or from hydrocarbon wells in which the gaseous hydrocarbons do not generate at least a threshold pressure.

As an illustrative, non-exclusive example, plunger lift systems require that the gaseous hydrocarbons develop at least the threshold pressure to provide a motive force to convey a plunger between the subterranean formation and the surface region. As another illustrative, non-exclusive example, rod pump systems utilize a mechanical linkage (i.e., a rod) that extends between the surface region and the subterranean formation; and, as the depth of the well (or length of the mechanical linkage) is increased, the mechanical linkage becomes more prone to failure and/or more prone to damage the casing. As yet another illustrative, non-exclusive example, neither plunger lift systems nor rod pump systems may be utilized as effectively in wellbores that include deviated and/or nonlinear regions.

Improved hydrocarbon well drilling technologies permit an operator to drill a hydrocarbon well that extends for many thousands of meters within the subterranean formation, that has a vertical depth of hundreds, or even thousands, of meters, and/or that has a highly deviated wellbore. These improved drilling technologies are routinely utilized to drill long and/or deep hydrocarbon wells that permit production of gaseous hydrocarbons from previously inaccessible subterranean formations.

However, wellbore liquids cannot be removed efficiently from these hydrocarbon wells using traditional artificial lift systems. Thus, there exists a need for improved systems and methods for artificial lift to remove wellbore liquids from a hydrocarbon well.

SUMMARY

In one aspect, disclosed herein is a system for removing wellbore liquids from a wellbore, the wellbore traversing a subterranean formation and having a tubular that extends within at least a portion of the wellbore. The system includes a positive-displacement solid state pump comprising a fluid chamber, an inlet and an outlet port, each in fluid communication with the fluid chamber, at least one solid state actuator, a first one-way check valve positioned between the inlet port and the fluid chamber, and/or a second one-way check valve positioned between the outlet port and the fluid chamber, the at least one solid state actuator configured to operate at or near its resonance frequency, the solid state pump positioned within the wellbore; and means for powering the solid state pump.

In some embodiments, the at least one solid state actuator is selected from piezoelectric, electrostrictive and/or magnetorestrictive actuators.

In some embodiments, the at least one solid state actuator comprise a ceramic perovskite material.

In some embodiments, the ceramic perovskite material comprises lead zirconate titanate and/or lead magnesium niobate.

In some embodiments, the at least one solid state actuator comprise terbium dysprosium iron.

In some embodiments, the first one-way check valve and/or the second one-way check valve are passive one-way disk valves, active one-way disk valves, passive microvalve arrays, active microvalve arrays, passive MEMS valve arrays, active MEMS valve arrays or a combination thereof.

In some embodiments, the solid state pump further comprises a piston and a cylinder for housing the at least one solid state actuator and the first and/or second one-way check valves, so as to form a piston pump.

In some embodiments, the solid state pump further comprises a diaphragm operatively associated with the at least one solid state actuator and the first and/or second the one-way check valves, so as to form a diaphragm pump.

In some embodiments, the means for powering the solid state pump is a power cable, the power cable operable for deploying the solid state pump.

In some embodiments, the power cable comprises a synthetic conductor.

In some embodiments, the means for powering the solid state pump is a rechargeable battery.

In some embodiments, the positive-displacement solid state pump is plugged into a downhole wet-mate connection and the means for powering the solid state pump is a power cable positioned on the outside of the tubular.

In some embodiments, the system further includes a profile seating nipple positioned within the tubular for receiving the solid state pump, the profile seating nipple having a locking groove structured and arranged to matingly engage the solid state pump.

In some embodiments, the system further includes a well screen or filter in fluid communication with the inlet end of the solid state pump, the well screen or filter having an inlet end and an outlet end; and a velocity fuse or standing valve positioned between the outlet end of the well screen or filter and the inlet end of the solid state pump.

In some embodiments, the velocity fuse is structured and arranged to back-flush the well screen or filter and maintain a column of fluid within the tubular in response to an increase in pressure drop across the velocity fuse.

In some embodiments, the system further includes an apparatus for reducing the force required to pull the positive-displacement solid state pump from the tubular, the apparatus comprising a tubular sealing device for mating with a downhole tubular component, the tubular sealing device having an axial length and a longitudinal bore therethrough; and an elongated rod slidably positionable within the longitudinal bore of the tubular sealing device, the elongated rod having an axial flow passage extending therethrough, a first end, a second end, and an outer surface, the outer surface structured and arranged to provide a hydraulic seal when the elongated rod is in a first position within the longitudinal bore of the tubular sealing device, and at least one external flow port for pressure equalization upstream and downstream of the tubular sealing device when the elongated rod is placed in a second position within the longitudinal bore of the tubular sealing device, wherein the tubular sealing device is structured and arranged for landing within a nipple profile or for attaching to a collar stop for landing directly within the tubular.

In some embodiments, the system further includes at least one secondary pump for transferring the wellbore liquids from the wellbore, wherein the inlet and outlet ports of the positive-displacement solid state pump are operatively connected to a hydraulic system to drive the at least one secondary pump and form a pump assembly.

In some embodiments, the at least one secondary pump is a bladder pump, a centrifugal pump, a rotary screw pump, a rotary lobe pump, a gerotor pump, and/or a progressive cavity pump.

In some embodiments, the bladder pump is a metal bellows pump or an elastomer pump.

In some embodiments, the system further includes a profile seating nipple positioned within the tubular for receiving the pump assembly, the profile seating nipple having a locking groove structured and arranged to matingly engage the solid state pump.

In some embodiments, the system further includes a well screen or filter in fluid communication with the inlet end of the pump, the well screen or filter having an inlet end and an outlet end; and a velocity fuse or standing valve positioned between the outlet end of the well screen or filter and the inlet end of the pump.

In some embodiments, the velocity fuse is structured and arranged to back-flush the well screen or filter and maintain a column of fluid within the tubular in response to an increase in pressure drop across the velocity fuse.

In some embodiments, the system further includes an apparatus for reducing the force required to pull the positive-displacement solid state pump from the tubular, the apparatus comprising a tubular sealing device for mating with the positive-displacement solid state pump, the tubular sealing device having an axial length and a longitudinal bore therethrough; and an elongated rod slidably positionable within the longitudinal bore of the tubular sealing device, the elongated rod having an axial flow passage extending therethrough, a first end, a second end, and an outer surface, the outer surface structured and arranged to provide a hydraulic seal when the elongated rod is in a first position within the longitudinal bore of the tubular sealing device, and at least one external flow port for pressure equalization upstream and downstream of the tubular sealing device when the elongated rod is placed in a second position within the longitudinal bore of the tubular sealing device, wherein the tubular sealing device is structured and arranged for landing within a nipple profile or for attaching to a collar stop for landing directly within the tubular.

In some embodiments, the apparatus is structured and arranged to be installed and retrieved from the tubular by a wireline or a coiled tubing.

In another aspect, disclosed herein is a method of removing wellbore liquid from a wellbore, the wellbore traversing a subterranean formation and having a tubular that extends within at least a portion of the wellbore. The method includes electrically powering a downhole positive-displacement solid state pump comprising a fluid chamber, an inlet and an outlet port, each in fluid communication with the fluid chamber, at least one solid state actuator, a first one-way check valve positioned between the inlet port and the fluid chamber, and/or a second one-way check valve positioned between the outlet port and the fluid chamber, the at least one solid state actuator configured to operate at or near its resonance frequency, the solid state pump positioned within the wellbore; and pumping the wellbore liquid from the wellbore with the downhole positive-displacement solid state pump, wherein the pumping includes: (i) pressurizing the wellbore liquid with the downhole positive-displacement solid state pump to generate a pressurized wellbore liquid at a discharge pressure; and (ii) flowing the pressurized wellbore liquid at least a threshold vertical distance to a surface region.

In some embodiments, the first one-way check valve and/or the second one-way check valve are passive one-way disk valves, active one-way disk valves, passive microvalve arrays, active microvalve arrays, passive MEMS valve arrays, active MEMS valve arrays or a combination thereof.

In some embodiments, the at least one solid state actuator is selected from piezoelectric, electrostrictive and/or magnetorestrictive actuators.

In some embodiments, the at least one solid state actuator comprise a ceramic perovskite material.

In some embodiments, the ceramic perovskite material comprises lead zirconate titanate and/or lead magnesium niobate.

In some embodiments, the at least one solid state actuator comprise terbium dysprosium iron.

In some embodiments, the solid state pump further comprises a piston and a cylinder for housing the at least one solid state actuator and the first and/or second one-way check valves, so as to form a piston pump.

In some embodiments, the solid state pump further comprises a diaphragm operatively associated with the at least one solid state actuator and the first and/or second one-way check valves, so as to form a diaphragm pump.

In some embodiments, the step of electrically powering the solid state pump comprises using a power cable, the power cable operable for deploying the solid state pump.

In some embodiments, the power cable comprises a synthetic conductor.

In some embodiments, the step of electrically powering the solid state pump comprises using a rechargeable battery.

In some embodiments, the positive-displacement solid state pump is plugged into a downhole wet-mate connection and the step of electrically powering the solid state pump comprises using a power cable positioned on the outside of the tubular.

In some embodiments, the method further includes the step of positioning a profile seating nipple within the tubular for receiving the solid state pump, the profile seating nipple having a locking groove structured and arranged to matingly engage the solid state pump.

In some embodiments, the method further includes the step of positioning a well screen or filter in fluid communication with the inlet end of the solid state pump, the well screen or filter having an inlet end and an outlet end; and a velocity fuse or standing valve positioned between the outlet end of the well screen or filter and the inlet end of the solid state pump.

In some embodiments, the velocity fuse is structured and arranged to back-flush the well screen or filter and maintain a column of fluid within the tubular in response to an increase in pressure drop across the velocity fuse.

In some embodiments, the method further includes the step of reducing the force required to pull the positive-displacement solid state pump from the tubular by using an apparatus comprising a tubular sealing device for mating with the positive-displacement solid state pump, the tubular sealing device having an axial length and a longitudinal bore therethrough; and an elongated rod slidably positionable within the longitudinal bore of the tubular sealing device, the elongated rod having an axial flow passage extending therethrough, a first end, a second end, and an outer surface, the outer surface structured and arranged to provide a hydraulic seal when the elongated rod is in a first position within the longitudinal bore of the tubular sealing device, and at least one external flow port for pressure equalization upstream and downstream of the tubular sealing device when the elongated rod is placed in a second position within the longitudinal bore of the tubular sealing device, wherein the tubular sealing device is structured and arranged for landing within a nipple profile or for attaching to a collar stop for landing directly within the tubular.

In some embodiments, the method further includes the step of forming a pump assembly by adding at least one secondary pump for transferring the wellbore liquids from the wellbore, wherein the inlet and outlet ports of the positive-displacement solid state pump are operatively connected to a hydraulic system to drive the at least one secondary pump.

In some embodiments, the at least one secondary pump is a bladder pump, a centrifugal pump, a rotary screw pump, a rotary lobe pump, a gerotor pump, and/or a progressive cavity pump.

In some embodiments, the bladder pump is a metal bellows pump or an elastomer pump.

In some embodiments, the method further includes the step of positioning a profile seating nipple within the tubular for receiving the pump assembly, the profile seating nipple having a locking groove structured and arranged to matingly engage the pump assembly.

In some embodiments, the method further includes the step of positioning a well screen or filter in fluid communication with the inlet end of the pump assembly, the well screen or filter having an inlet end and an outlet end; and a velocity fuse or standing valve positioned between the outlet end of the well screen or filter and the inlet end of the pump assembly.

In some embodiments, the velocity fuse is structured and arranged to back-flush the well screen or filter and maintain a column of fluid within the tubular in response to an increase in pressure drop across the velocity fuse.

In some embodiments, the method further includes the step of reducing the force required to pull the pump assembly from the tubular by using an apparatus comprising a tubular sealing device for mating with the pump assembly, the tubular sealing device having an axial length and a longitudinal bore therethrough; and an elongated rod slidably positionable within the longitudinal bore of the tubular sealing device, the elongated rod having an axial flow passage extending therethrough, a first end, a second end, and an outer surface, the outer surface structured and arranged to provide a hydraulic seal when the elongated rod is in a first position within the longitudinal bore of the tubular sealing device, and at least one external flow port for pressure equalization upstream and downstream of the tubular sealing device when the elongated rod is placed in a second position within the longitudinal bore of the tubular sealing device, wherein the tubular sealing device is structured and arranged for landing within a nipple profile or for attaching to a collar stop for landing directly within the tubular.

In some embodiments, the apparatus is structured and arranged to be installed and retrieved from the tubular by a wireline or a coiled tubing.

In some embodiments, the method further includes detecting a downhole process parameter.

In some embodiments, the downhole process parameter includes at least one of a downhole temperature, a downhole pressure, the discharge pressure, system vibration, a downhole flow rate, and the discharge flow rate.

BRIEF DESCRIPTION OF THE DRAWINGS

The present disclosure is susceptible to various modifications and alternative forms, specific exemplary implementations thereof have been shown in the drawings and are herein described in detail. It should be understood, however, that the description herein of specific exemplary implementations is not intended to limit the disclosure to the particular forms disclosed herein. This disclosure is to cover all modifications and equivalents as defined by the appended claims. It should also be understood that the drawings are not necessarily to scale, emphasis instead being placed upon clearly illustrating principles of exemplary embodiments of the present invention. Moreover, certain dimensions may be exaggerated to help visually convey such principles. Further where considered appropriate, reference numerals may be repeated among the drawings to indicate corresponding or analogous elements. Moreover, two or more blocks or elements depicted as distinct or separate in the drawings may be combined into a single functional block or element. Similarly, a single block or element illustrated in the drawings may be implemented as multiple steps or by multiple elements in cooperation. The forms disclosed herein are illustrated by way of example, and not by way of limitation, in the figures of the accompanying drawings and in which like reference numerals refer to similar elements and in which:

DETAILED DESCRIPTION

Terminology

Figure 1:
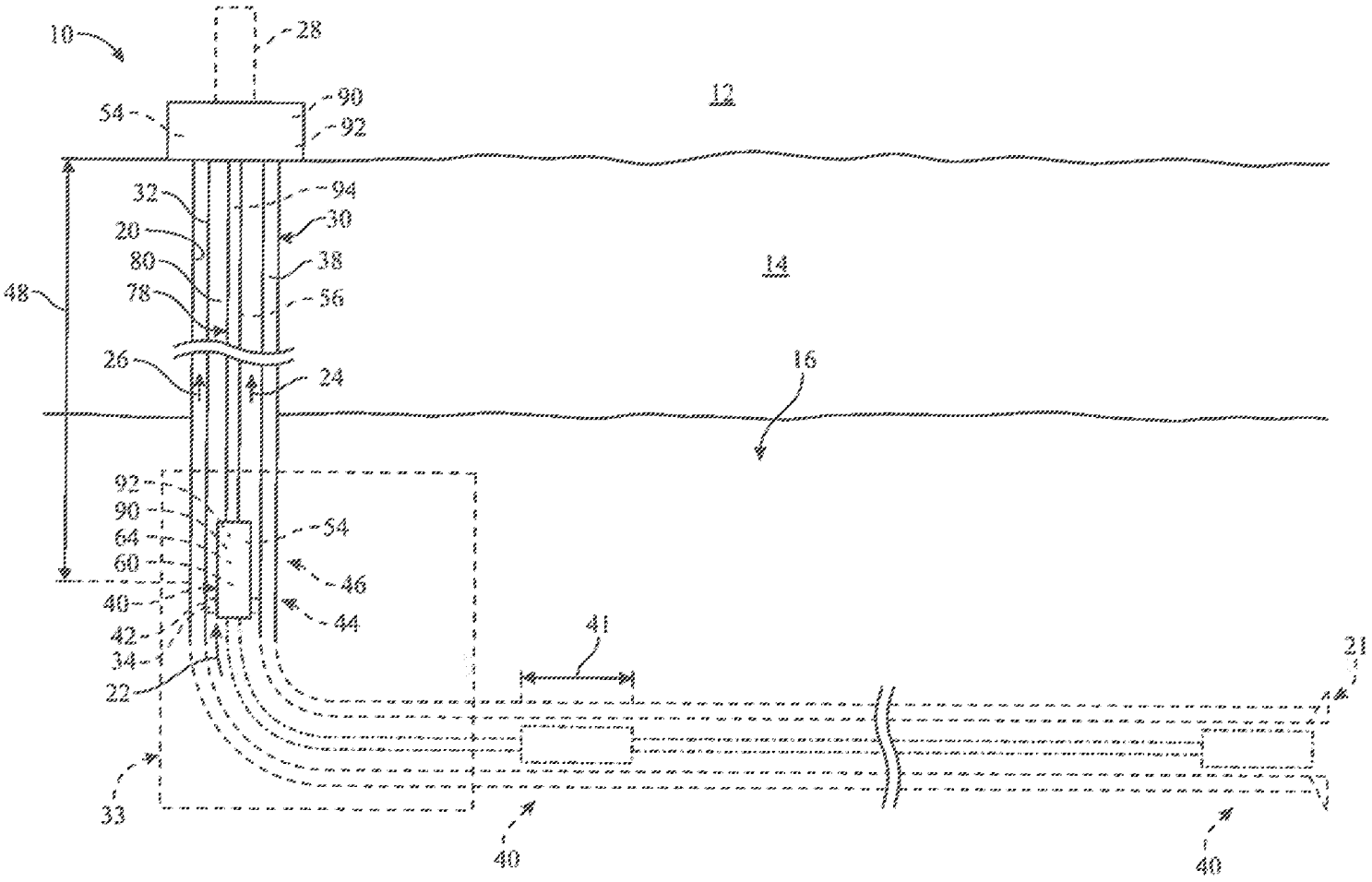
FIG. 1 is a schematic representation of illustrative, non-exclusive examples of a hydrocarbon well that may be utilized with and/or may include the systems and methods, according to the present disclosure.

The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than the broadest meaning understood by skilled artisans, such a special or clarifying definition will be expressly set forth in the specification in a definitional manner that provides the special or clarifying definition for the term or phrase.

For example, the following discussion contains a non-exhaustive list of definitions of several specific terms used in this disclosure (other terms may be defined or clarified in a definitional manner elsewhere herein). These definitions are intended to clarify the meanings of the terms used herein. It is believed that the terms are used in a manner consistent with their ordinary meaning, but the definitions are nonetheless specified here for clarity.

A/an: The articles "a" and "an" as used herein mean one or more when applied to any feature in embodiments and implementations of the present invention described in the specification and claims. The use of "a" and "an" does not limit the meaning to a single feature unless such a limit is specifically stated. The term "a" or "an" entity refers to one or more of that entity. As such, the terms "a" (or "an"), "one or more" and "at least one" can be used interchangeably herein.

About: As used herein, "about" refers to a degree of deviation based on experimental error typical for the particular property identified. The latitude provided the term "about" will depend on the specific context and particular property and can be readily discerned by those skilled in the art. The term "about" is not intended to either expand or limit the degree of equivalents which may otherwise be afforded a particular value. Further, unless otherwise stated, the term "about" shall expressly include "exactly," consistent with the discussion below regarding ranges and numerical data.

Above/below: In the following description of the representative embodiments of the invention, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore. Continuing with the example of relative directions in a wellbore, "upper" and "lower" may also refer to relative positions along the longitudinal dimension of a wellbore rather than relative to the surface, such as in describing both vertical and horizontal wells.

And/or: The term "and/or" placed between a first entity and a second entity means one of (1) the first entity, (2) the second entity, and (3) the first entity and the second entity. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements). As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of".

Any: The adjective "any" means one, some, or all indiscriminately of whatever quantity.

At least: As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements). The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

Based on: "Based on" does not mean "based only on", unless expressly specified otherwise. In other words, the phrase "based on" describes both "based only on," "based at least on," and "based at least in part on."

Comprising: In the claims, as well as in the specification, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

Couple: Any use of any form of the terms "connect", "engage", "couple", "attach", or any other term describing an interaction between elements is not meant to limit the interaction to direct interaction between the elements and may also include indirect interaction between the elements described.

Determining: "Determining" encompasses a wide variety of actions and therefore "determining" can include calculating, computing, processing, deriving, investigating, looking up (e.g., looking up in a table, a database or another data structure), ascertaining and the like. Also, "determining" can include receiving (e.g., receiving information), accessing (e.g., accessing data in a memory) and the like. Also, "determining" can include resolving, selecting, choosing, establishing and the like.

Embodiments: Reference throughout the specification to "one embodiment," "an embodiment," "some embodiments," "one aspect," "an aspect," "some aspects," "some implementations," "one implementation," "an implementation," or similar construction means that a particular component, feature, structure, method, or characteristic described in connection with the embodiment, aspect, or implementation is included in at least one embodiment and/or implementation of the claimed subject matter. Thus, the appearance of the phrases "in one embodiment" or "in an embodiment" or "in some embodiments" (or "aspects" or "implementations") in various places throughout the specification are not necessarily all referring to the same embodiment and/or implementation. Furthermore, the particular features, structures, methods, or characteristics may be combined in any suitable manner in one or more embodiments or implementations.

Exemplary: "Exemplary" is used exclusively herein to mean "serving as an example, instance, or illustration." Any embodiment described herein as "exemplary" is not necessarily to be construed as preferred or advantageous over other embodiments.

Flow diagram: Exemplary methods may be better appreciated with reference to flow diagrams or flow charts. While for purposes of simplicity of explanation, the illustrated methods are shown and described as a series of blocks, it is to be appreciated that the methods are not limited by the order of the blocks, as in different embodiments some blocks may occur in different orders and/or concurrently with other blocks from that shown and described. Moreover, less than all the illustrated blocks may be required to implement an exemplary method. In some examples, blocks may be combined, may be separated into multiple components, may employ additional blocks, and so on. In some examples, blocks may be implemented in logic. In other examples, processing blocks may represent functions and/or actions performed by functionally equivalent circuits (e.g., an analog circuit, a digital signal processor circuit, an application specific integrated circuit (ASIC)), or other logic device. Blocks may represent executable instructions that cause a computer, processor, and/or logic device to respond, to perform an action(s), to change states, and/or to make decisions. While the figures illustrate various actions occurring in serial, it is to be appreciated that in some examples various actions could occur concurrently, substantially in series, and/or at substantially different points in time. In some examples, methods may be implemented as processor executable instructions. Thus, a machine-readable medium may store processor executable instructions that if executed by a machine (e.g., processor) cause the machine to perform a method.

Full-physics: As used herein, the term "full-physics," "full physics computational simulation," or "full physics simulation" refers to a mathematical algorithm based on first principles that impact the pertinent response of the simulated system.

May: Note that the word "may" is used throughout this application in a permissive sense (i.e., having the potential to, being able to), not a mandatory sense (i.e., must).

Operatively connected and/or coupled: Operatively connected and/or coupled means directly or indirectly connected for transmitting or conducting information, force, energy, or matter.

Optimizing: The terms "optimal," "optimizing," "optimize," "optimality," "optimization" (as well as derivatives and other forms of those terms and linguistically related words and phrases), as used herein, are not intended to be limiting in the sense of requiring the present invention to find the best solution or to make the best decision. Although a mathematically optimal solution may in fact arrive at the best of all mathematically available possibilities, real-world embodiments of optimization routines, methods, models, and processes may work towards such a goal without ever actually achieving perfection. Accordingly, one of ordinary skill in the art having benefit of the present disclosure will appreciate that these terms, in the context of the scope of the present invention, are more general. The terms may describe one or more of: 1) working towards a solution which may be the best available solution, a preferred solution, or a solution that offers a specific benefit within a range of constraints; 2) continually improving; 3) refining; 4) searching for a high point or a maximum for an objective; 5) processing to reduce a penalty function; 6) seeking to maximize one or more factors in light of competing and/or cooperative interests in maximizing, minimizing, or otherwise controlling one or more other factors, etc.

Order of steps: It should also be understood that, unless clearly indicated to the contrary, in any methods claimed herein that include more than one step or act, the order of the steps or acts of the method is not necessarily limited to the order in which the steps or acts of the method are recited.

Ranges: Concentrations, dimensions, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a range of about 1 to about 200 should be interpreted to include not only the explicitly recited limits of 1 and about 200, but also to include individual sizes such as 2, 3, 4, etc. and sub-ranges such as 10 to 50, 20 to 100, etc. Similarly, it should be understood that when numerical ranges are provided, such ranges are to be construed as providing literal support for claim limitations that only recite the lower value of the range as well as claims limitation that only recite the upper value of the range. For example, a disclosed numerical range of 10 to 100 provides literal support for a claim reciting "greater than 10" (with no upper bounds) and a claim reciting "less than 100" (with no lower bounds).

As used herein, the term "formation" refers to any definable subsurface region. The formation may contain one or more hydrocarbon-containing layers, one or more non-hydrocarbon containing layers, an overburden, and/or an underburden of any geologic formation.

As used herein, the term "hydrocarbon" refers to an organic compound that includes primarily, if not exclusively, the elements hydrogen and carbon. Examples of hydrocarbons include any form of natural gas, oil, coal, and bitumen that can be used as a fuel or upgraded into a fuel.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions, or at ambient conditions (20° C. and 1 atm pressure). Hydrocarbon fluids may include, for example, oil, natural gas, gas condensates, coal bed methane, shale oil, shale gas, and other hydrocarbons that are in a gaseous or liquid state.

As used herein, the term "potting" refers to the encapsulation of electrical components with epoxy, elastomeric, silicone, or asphaltic or similar compounds for the purpose of excluding moisture or vapors. Potted components may or may not be hermetically sealed.

As used herein, the term "sensor" includes any electrical sensing device or gauge. The sensor may be capable of monitoring or detecting pressure, temperature, fluid flow, vibration, resistivity, or other formation data. Alternatively, the sensor may be a position sensor.

As used herein, the term "subsurface" refers to geologic strata occurring below the earth's surface.

The terms "tubular member" or "tubular body" refer to any pipe, such as a joint of casing, a portion of a liner, a drill string, a production tubing, an injection tubing, a pup joint, a buried pipeline, underwater piping, or above-ground piping. solid lines therein, and any suitable number of such structures and/or features may be omitted from a given embodiment without departing from the scope of the present disclosure.

As used herein, the term "wellbore" refers to a hole in the subsurface made by drilling or insertion of a conduit into the subsurface. A wellbore may have a substantially circular cross section, or other cross-sectional shape. As used herein, the term "well," when referring to an opening in the formation, may be used interchangeably with the term "wellbore."

The terms "zone" or "zone of interest" refer to a portion of a subsurface formation containing hydrocarbons. The term "hydrocarbon-bearing formation" may alternatively be used.

DESCRIPTION

Specific forms will now be described further by way of example. While the following examples demonstrate certain forms of the subject matter disclosed herein, they are not to be interpreted as limiting the scope thereof, but rather as contributing to a complete description.

FIGS. 1-23 provide illustrative, non-exclusive examples of a system and method for removing fluids from a subterranean well, according to the present disclosure, together with elements that may include, be associated with, be operatively attached to, and/or utilize such a method or system.

In FIGS. 1-23, like numerals denote like, or similar, structures and/or features; and each of the illustrated structures and/or features may not be discussed in detail herein with reference to the figures. Similarly, each structure and/or feature may not be explicitly labeled in the figures; and any structure and/or feature that is discussed herein with reference to the figures may be utilized with any other structure and/or feature without departing from the scope of the present disclosure.

In general, structures and/or features that are, or are likely to be, included in a given embodiment are indicated in solid lines in the figures, while optional structures and/or features are indicated in broken lines. However, a given embodiment is not required to include all structures and/or features that are illustrated in solid lines therein, and any suitable number of such structures and/or features may be omitted from a given embodiment without departing from the scope of the present disclosure.

Although the approach disclosed herein can be applied to a variety of subterranean well designs and operations, the present description will primarily be directed to systems for removing fluids from a subterranean well.

Figure 2:
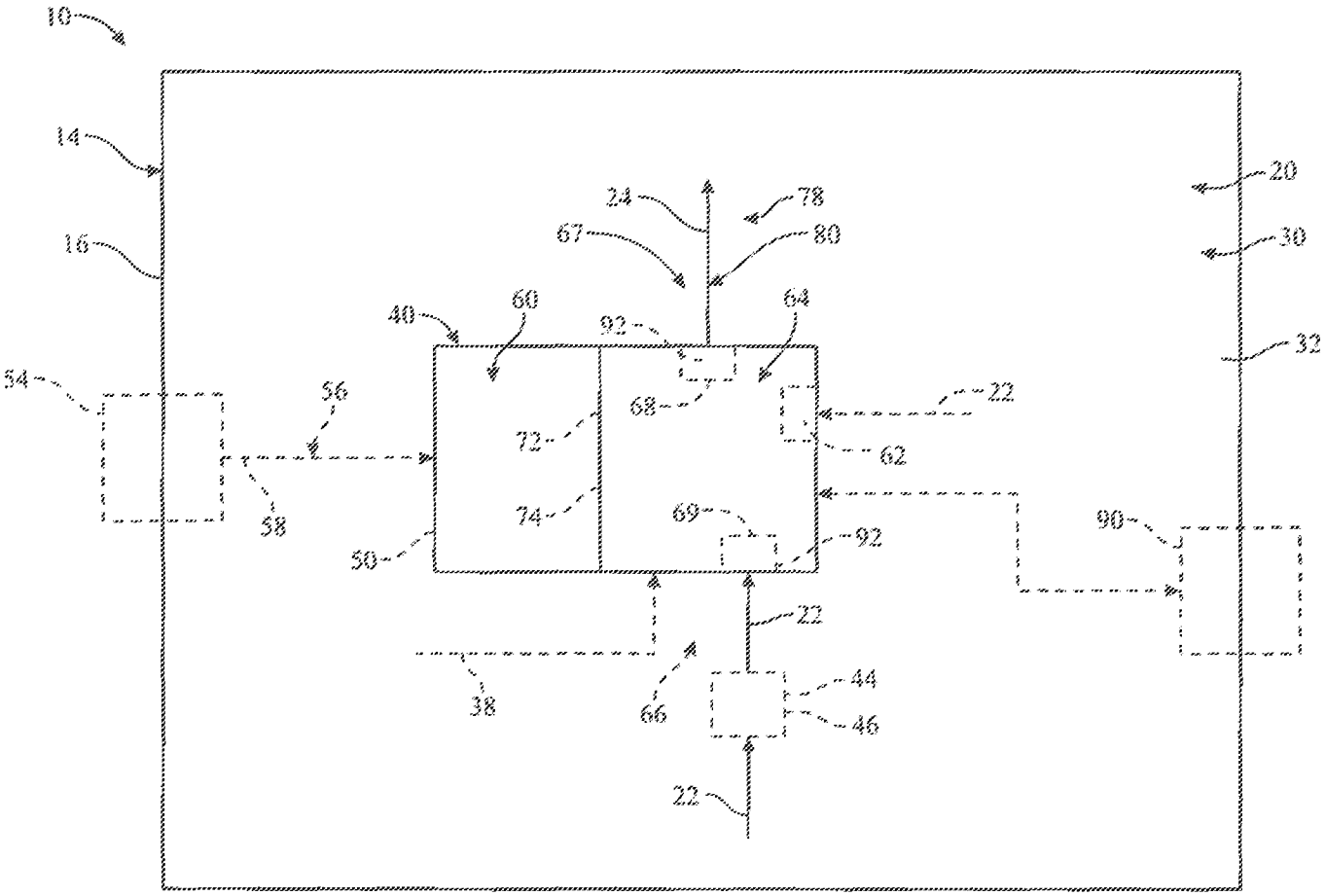
FIG. 2 is a schematic block diagram of illustrative, non-exclusive examples of a positive-displacement solid state pump, according to the present disclosure.

FIG. 1 is a schematic representation of illustrative, non-exclusive examples of a hydrocarbon well 10 that may be utilized with and/or include the systems and methods according to the present disclosure, while FIG. 2 is a schematic block diagram of illustrative, non-exclusive examples of a positive-displacement solid state pump 40 according to the present disclosure that may be utilized with hydrocarbon well 10. Hydrocarbon well 10 includes a wellbore 20 that extends between a surface region 12 and a subterranean formation 16 that is present within a subsurface region 14. The hydrocarbon well further includes a casing 30 that extends within the wellbore and defines a casing conduit 32.

Positive-displacement solid state pump 40 is located within the casing conduit at least a threshold vertical distance 48 from surface region 12. Threshold vertical distance 48 additionally or alternatively may be referred to herein as threshold vertical depth 48. The positive-displacement solid state pump is configured to receive a wellbore liquid 22 and to pressurize the wellbore liquid to generate a pressurized wellbore liquid 24. A tubing 78 defines a liquid discharge conduit 80 that may extend between positive-displacement solid state pump 40 and surface region 12. The liquid discharge conduit is in fluid communication with casing conduit 32 via positive-displacement solid state pump 40 and is configured to convey pressurized wellbore liquid 24 from the casing conduit, such as to surface region 12.

As illustrated in dashed lines in FIG. 1, hydrocarbon well 10 may include a lubricator 28 that may be utilized to locate (i.e., insert and/or position) positive-displacement solid state pump 40 within casing conduit 32 and/or to remove the positive-displacement solid state pump from the casing conduit. In addition, an injection conduit 38 may extend between surface region 12 and positive-displacement solid state pump 40 and may be configured to inject a corrosion inhibitor and/or a scale inhibitor into casing conduit 32 and/or into fluid contact with positive-displacement solid state pump 40, such as to decrease a potential for corrosion of and/or scale build-up within the positive-displacement solid state pump.

As also illustrated in dashed lines, hydrocarbon well 10 and/or positive-displacement solid state pump 40 further may include a sand control structure 44, which may be configured to limit flow of sand into an inlet 66 of positive-displacement solid state pump 40, and/or a gas control structure 46, which may limit flow of a wellbore gas 26 into inlet 66 of positive-displacement solid state pump 40. As further illustrated in dashed lines in FIG. 1, tubing 78 may have a seat 34 attached thereto and/or included therein, with seat 34 being configured to receive positive-displacement solid state pump 40 and/or to retain positive-displacement solid state pump 40 at, or within, a desired region and/or location within tubing 78. Additionally or alternatively, positive-displacement solid state pump 40 may include and/or be operatively attached to a packer 42. Packer 42 may be configured to swell or otherwise be expanded within tubing conduit 80 and to thereby retain positive-displacement solid state pump 40 at, or within, the desired region and/or location within tubing 78.

Still referring to FIGS. 1-2, hydrocarbon well 10 and/or positive-displacement solid state pump 40 thereof further may include a means for powering the solid state pump 54 that is configured to provide an electric current to positive-displacement solid state pump 40. In addition, a sensor 92 may be configured to detect a downhole process parameter and may be located within wellbore 20, may be operatively attached to positive-displacement solid state pump 40, and/or may form a portion of the positive-displacement solid state pump. The sensor may be configured to convey a data signal that is indicative of the process parameter to surface region 12 and/or may be in communication with a controller 90 that is configured to control the operation of at least a portion of positive-displacement solid state pump 40.

As also discussed, positive-displacement solid state pump 40 may be powered by (or receive an electric current 58 from) means for powering the solid state pump 54, which may be operatively attached to the positive-displacement solid state pump, may form a portion of the positive-displacement solid state pump, and/or may be in electrical communication with the positive-displacement solid state pump via an electrical conduit 56. Thus, positive-displacement solid state pump 40 according to the present disclosure may be configured to generate pressurized wellbore liquid 24 without utilizing a reciprocating mechanical linkage that extends between surface region 12 and the positive-displacement solid state pump (such as might be utilized with traditional rod pump systems) to provide a motive force for operation of the positive-displacement solid state pump. This may permit positive-displacement solid state pump 40 to be utilized in long, deep, and/or deviated wellbores where traditional rod pump systems may be ineffective, inefficient, and/or unable to generate the pressurized wellbore liquid 24.

Similarly, and since positive-displacement solid state pump 40 is powered by means for powering the solid state pump 54, the positive-displacement solid state pump may be configured to generate pressurized wellbore liquid 24 (and/or to remove the pressurized wellbore liquid from casing conduit 32 via liquid discharge conduit 80) without requiring a threshold minimum pressure of wellbore gas 26. This may permit positive-displacement solid state pump 40 to be utilized in hydrocarbon wells 10 that do not develop sufficient gas pressure to permit utilization of traditional plunger lift systems and/or that define long and/or deviated casing conduits 32 that preclude the efficient operation of traditional plunger lift systems.

Furthermore, positive-displacement solid state pump 40 may operate as a positive displacement pump and thus may be sized, designed, and/or configured to generate pressurized wellbore liquid 24 at a pressure that is sufficient to permit the pressurized wellbore liquid to be conveyed via liquid discharge conduit 80 to surface region 12 without utilizing a large number of pumping stages. It follows that reducing the number of pumping stages may decrease a length 41 of the positive-displacement solid state pump (as illustrated in FIG. 1). As illustrative, non-exclusive examples, positive-displacement solid state pump 40 may include fewer than five stages, fewer than four stages, fewer than three stages, or a single stage.

As additional illustrative, non-exclusive examples, the length of the positive-displacement solid state pump may be less than 30 meters (m), less than 28 m, less than 26 m, less than 24 m, less than 22 m, less than 20 m, less than 18 m, less than 16 m, less than 14 m, less than 12 m, less than 10 m, less than 8 m, less than 6 m, or less than 4 m. Additionally or alternatively, an outer diameter of the positive-displacement solid state pump may be less than 20 centimeters (cm), less than 18 cm, less than 16 cm, less than 14 cm, less than 12 cm, less than 10 cm, less than 9 cm, less than 8 cm, less than 7 cm, less than 6 cm, or less than 5 cm.

This small length and/or small diameter of positive-displacement solid state pumps 40, according to the present disclosure, may permit the positive-displacement solid state pumps 40 to be located within and/or to flow through and/or past deviated regions 33 within wellbore 20 and/or casing conduit 32. These deviated regions might obstruct and/or retain longer and/or larger-diameter traditional pumping systems that do not include positive-displacement solid state pump 40 and/or that utilize a larger number (such as more than 5, more than 6, more than 8, more than 10, more than 15, or more than 20) of stages to generate pressurized wellbore liquid 24. Thus, positive-displacement solid state pumps 40 according to the present disclosure may be operable in hydrocarbon wells 10 that are otherwise inaccessible to more traditional artificial lift systems. This may include locating positive-displacement solid state pump 40 uphole from deviated regions 33, as schematically illustrated in dashed lines in FIG. 1, and/or locating positive-displacement solid state pump 40 downhole from deviated regions 33, such as in a horizontal portion of wellbore 20 and/or near a toe end 21 of wellbore 20 (as schematically illustrated in dash-dot lines in FIG. 1).

Additionally or alternatively, the (relatively) small length and/or the (relatively) small diameter of positive-displacement solid state pumps 40 according to the present disclosure may permit the positive-displacement solid state pumps to be located within casing conduit 32 and/or removed from casing conduit 32 via lubricator 28. This may permit the positive-displacement solid state pumps to be located within the casing conduit without depressurizing hydrocarbon well 10, without killing well 10, without first supplying a kill weight fluid to wellbore 20, and/or while containing wellbore fluids within the wellbore. This may increase an overall efficiency of operations that insert positive-displacement solid state pumps into and/or remove positive-displacement solid state pumps from wellbore 20, may decrease a time required to permit positive-displacement solid state pumps 40 to be inserted into and/or removed from wellbore 20, and/or may decrease a potential for damage to hydrocarbon well 10 when positive-displacement solid state pumps 40 are inserted into and/or removed from wellbore 20.

Furthermore, and as discussed in more detail herein, positive-displacement solid state pumps 40, according to the present disclosure, may be configured to generate pressurized wellbore liquid 24 at relatively low discharge flow rates and/or at selectively variable discharge flow rates. This may permit positive-displacement solid state pumps 40 to efficiently operate in low production rate hydrocarbon wells and/or in hydrocarbon wells that generate low volumes of wellbore liquid 22, in contrast to more traditional artificial lift systems.

Positive-displacement solid state pump 40 includes a solid state element 60 and a fluid chamber 64. Solid state element 60 may be configured to selectively and/or repeatedly transition from an extended state to a contracted state during an intake stroke of the positive-displacement solid state pump and to subsequently transition from the contracted state to the expanded state during an exhaust stroke of the positive-displacement solid state pump. This may include transitioning between the extended state and the contracted state responsive to receipt of electric current 58, which may be an AC electric current.

Fluid chamber 64 may be configured to receive wellbore liquid 22 from wellbore 20, such as via inlet 66, during the intake stroke of the positive-displacement solid state pump and to emit, or discharge, pressurized wellbore liquid 24, such as through an outlet 67, during the exhaust stroke of the positive-displacement solid state pump. As illustrated schematically in FIG. 2 and discussed in more detail hereinbelow, positive-displacement solid state pump 40 further may include a housing 50, a first one-way check valve positioned between the inlet port and the fluid chamber 69, a second one-way check valve positioned between the outlet port and the fluid chamber 68, a sealing structure 72, and/or an isolation structure 74. Positive-displacement solid state pump 40 also may include a liquid inlet valve 62. Liquid inlet valve 62 may be configured to selectively introduce wellbore liquid 22 into fluid chamber 64 of positive-displacement solid state pump 40, as discussed in more detail herein.

As discussed, wellbore 20 may define deviated region 33, which also may be referred to herein as a nonlinear region 33, that may have a deviated (i.e., nonvertical) and/or nonlinear trajectory within subsurface region 14 and/or subterranean formation 16 thereof (as schematically illustrated in FIG. 1). In addition and as also discussed, positive-displacement solid state pump 40 may be located downhole from deviated region 33. As illustrative, non-exclusive examples, nonlinear region 33 may include and/or be a tortuous region, a curvilinear region, an L-shaped region, an S-shaped region, and/or a transition region between a (substantially) horizontal region and a (substantially) vertical region that may define a tortuous trajectory, a curvilinear trajectory, a deviated trajectory, an L-shaped trajectory, an S-shaped trajectory, and/or a transitional, or changing, trajectory.

Means for powering the solid state pump 54 may include any suitable structure that may be configured to provide the electric current to positive-displacement solid state pump 40, and/or to solid state element 60 thereof, and may be present in any suitable location. As an illustrative, non-exclusive example, means for powering the solid state pump 54 may be located in surface region 12, and electrical conduit 56 may extend between the means for powering the solid state pump and the positive-displacement solid state pump. Illustrative, non-exclusive examples of electrical conduit 56 include any suitable wire, cable, wireline, and/or working line and electrical conduit 56 may connect to positive-displacement solid state pump 40 via any suitable electrical connection and/or wet-mate connection.

As another illustrative, non-exclusive example, means for powering the solid state pump 54 may include and/or be a battery pack. The battery pack may be located within surface region 12, may be located within wellbore 20, and/or may be operatively and/or directly attached to positive-displacement solid state pump 40.

As additional illustrative, non-exclusive examples, means for powering the solid state pump 54 may include and/or be a generator, an AC generator, a DC generator, a turbine, a solar-powered means for powering the solid state pump, a wind-powered means for powering the solid state pump, and/or a hydrocarbon-powered means for powering the solid state pump that may be located within surface region 12 and/or within wellbore 20. When means for powering the solid state pump 54 is located within wellbore 20, the means for powering the solid state pump also may be referred to herein as a downhole power generation assembly 54.

As discussed in more detail herein, a discharge flow rate of pressurized wellbore liquid 24 that is generated by positive-displacement solid state pump 40 may be controlled, regulated, and/or varied by controlling, regulating, and/or varying a frequency of an AC electric current that is provided to positive-displacement solid state pump 40 and/or to solid state element 60 thereof. This may include increasing the frequency of the AC electric current to increase the discharge flow rate (by decreasing a time that it takes for the positive-displacement solid state pump to transition between the extended state and the contracted state) and/or decreasing the frequency of the AC electric current to decrease the discharge flow rate (by increasing the time that it takes for the positive-displacement solid state pump to transition between the extended state and the contracted state).

Illustrative, non-exclusive examples of the frequency of the AC electric current include frequencies of at least 0.01 Hertz (Hz), at least 0.05 Hz, at least 0.1 Hz, at least 0.5 Hz, at least 1 Hz, at least 5 Hz, at least 10 Hz, at least 20 Hz, at least 30 Hz, at least 40 Hz, at least 60 Hz, at least 80 Hz, and/or at least 100 Hz. Additional illustrative, non-exclusive examples of the frequency of the AC electric current include frequencies of less than 4000 Hz, less than 3500 Hz, less than 3000 Hz, less than 2500 Hz, less than 2000 Hz, less than 1500 Hz, less than 1000 Hz, less than 750 Hz, less than 500 Hz, less than 250 Hz, less than 200 Hz, less than 150 Hz, and/or less than 100 Hz. Further illustrative, non-exclusive examples of the frequency of the AC electric current include frequencies in any range of the preceding minimum and maximum frequencies.

Sensor 92 may include any suitable structure that is configured to detect the downhole process parameter. Illustrative, non-exclusive examples of the downhole process parameter include a downhole temperature, a downhole pressure, a discharge pressure from the positive-displacement solid state pump, system vibration, a downhole flow rate, and/or a discharge flow rate from the positive-displacement solid state pump.

It is within the scope of the present disclosure that sensor 92 may be configured to detect the downhole process parameter at any suitable location within wellbore 20. As an illustrative, non-exclusive example, the sensor may be located such that the downhole process parameter is indicative of a condition at an inlet to positive-displacement solid state pump 40. As another illustrative, non-exclusive example, the sensor may be located such that the downhole process parameter is indicative of a condition at an outlet from positive-displacement solid state pump 40.

When hydrocarbon well 10 includes sensor 92, the hydrocarbon well also may include a data communication conduit 94 (as illustrated in FIG. 1) that may be configured to convey a signal that is indicative of the downhole process parameter between sensor 92 and surface region 12. As an illustrative, non-exclusive example, controller 90 may be located within surface region 12, and data communication conduit 94 may convey the signal to the controller. As another illustrative, non-exclusive example, the data communication conduit may convey the signal to a display and/or to a terminal that is located within surface region 12.

Controller 90 may include any suitable structure that may be configured to control the operation of any suitable portion of hydrocarbon well 10, such as positive-displacement solid state pump 40. This may include controlling using methods 300, which are discussed in more detail herein.

As illustrated in FIG. 1, controller 90 may be located in any suitable portion of hydrocarbon well 10. As an illustrative, non-exclusive example, the controller may include and/or be an autonomous and/or automatic controller that is located within wellbore 20 and/or that is directly and/or operatively attached to positive-displacement solid state pump 40. Thus, controller 90 may be configured to control the operation of positive-displacement solid state pump 40 without requiring that a data signal be conveyed to surface region 12 via data communication conduit 94. Additionally or alternatively, controller 90 may be located within surface region 12 and may communicate with positive-displacement solid state pump 40 via data communication conduit 94.

As an illustrative, non-exclusive example, controller 90 may be programmed to maintain a target wellbore liquid level within wellbore 20 above positive-displacement solid state pump 40. This may include increasing a discharge flow rate of pressurized wellbore liquid 24 that is generated by the positive-displacement solid state pump to decrease the wellbore liquid level and/or decreasing the discharge flow rate to increase the wellbore liquid level.

As another illustrative, non-exclusive example, controller 90 may be programmed to regulate the discharge flow rate to control the discharge pressure from the positive-displacement solid state pump. This may include increasing the discharge flow rate to increase the discharge pressure and/or decreasing the discharge flow rate to decrease the discharge pressure.

As a more specific but still illustrative, non-exclusive example, and when hydrocarbon well 10 includes sensor 92, controller 90 may be programmed to control a frequency of the AC electric current that is provided to positive-displacement solid state pump 40, thus controlling the discharge flow rate, based, at least in part, on the downhole process parameter. This may include increasing the frequency of the AC electric current to increase the discharge flow rate and/or decreasing the frequency of the AC electric current to decrease the discharge flow rate.

As another more specific but still illustrative, non-exclusive example, and when positive-displacement solid state pump 40 includes liquid inlet valve 62, controller 90 may be programmed to control the operation of the liquid inlet valve. This may include opening the liquid inlet valve to permit wellbore fluid to enter fluid chamber 64 of the positive-displacement solid state pump responsive to the downhole process parameter indicating a gas lock condition of the positive-displacement solid state pump.

As discussed, positive-displacement solid state pump 40, according to the present disclosure, may be utilized to provide artificial lift in wellbores that define a large vertical distance, or depth, 48, in wellbores that define a large overall length, and/or in wellbores in which positive-displacement solid state pump 40 is located at least a threshold vertical distance from surface region 12.

As illustrative, non-exclusive examples, the vertical depth of wellbore 20, the overall length of wellbore 20, and/or the threshold vertical distance of positive-displacement solid state pump 40 from surface region 12 may be at least 250 meters (m), at least 500 m, at least 750 m, at least 1000 m, at least 1250 m, at least 1500 m, at least 1750 m, at least 2000 m, at least 2250 m, at least 2500 m, at least 2750 m, at least 3000 m, at least 3250 m, and/or at least 3500 m. Additionally or alternatively, the vertical depth of wellbore 20, the overall length of wellbore 20, and/or the threshold vertical distance of positive-displacement solid state pump 40 from surface region 12 may be less than 8000 m, less than 7750 m, less than 7500 m, less than 7250 m, less than 7000 m, less than 6750 m, less than 6500 m, less than 6250 m, less than 6000 m, less than 5750 m, less than 5500 m, less than 5250 m, less than 5000 m, less than 4750 m, less than 4500 m, less than 4250 m, and/or less than 4000 m. Further additionally or alternatively, the vertical depth of wellbore 20, the overall length of wellbore 20, and/or the threshold vertical distance of positive-displacement solid state pump 40 from surface region 12 may be in a range defined, or bounded, by any combination of the preceding maximum and minimum depths.

Figure 3:
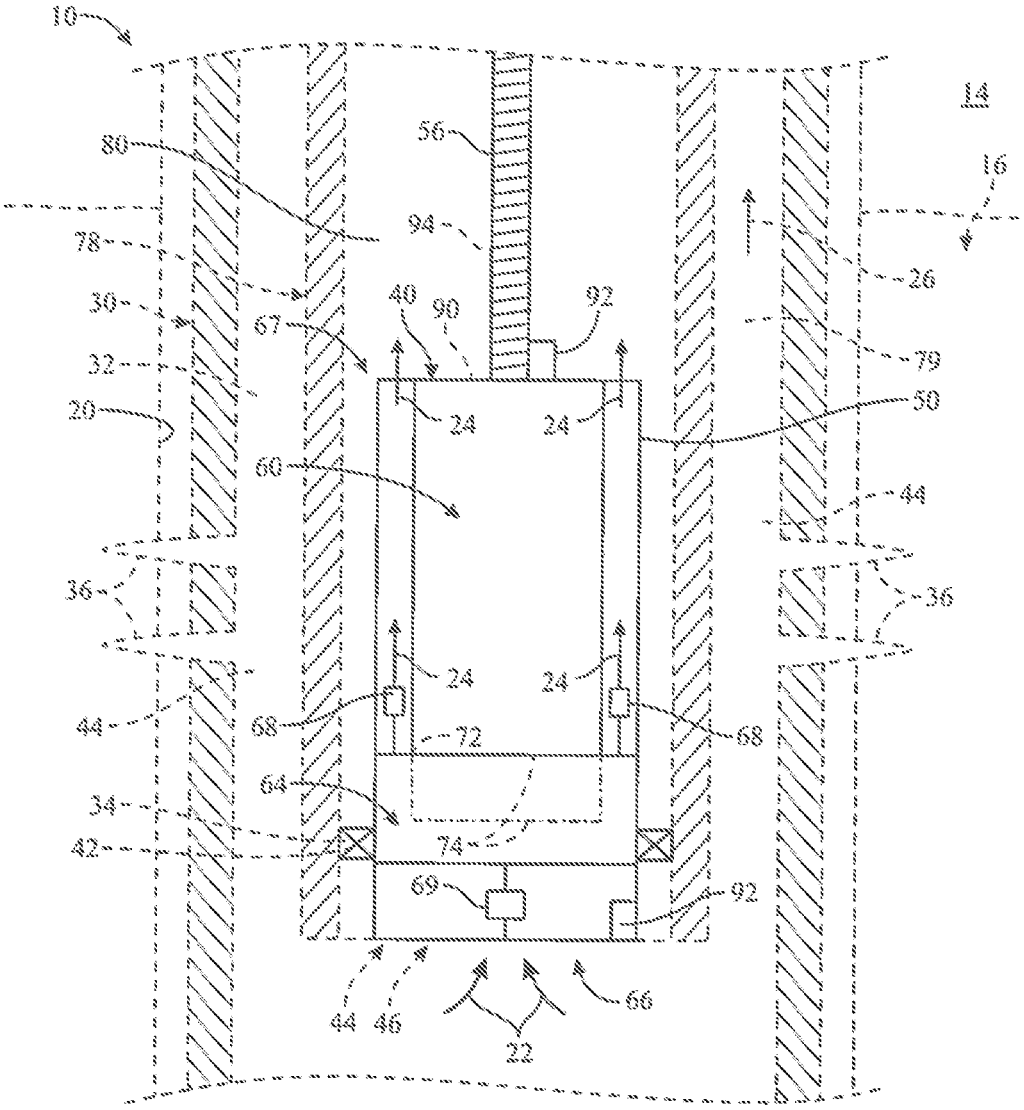
FIG. 3 is a fragmentary partial cross-sectional view of illustrative, non-exclusive examples of a hydrocarbon well that includes a positive-displacement solid state pump, according to the present disclosure.

FIG. 3 provides a further illustrative, non-exclusive example of a hydrocarbon well 10 that includes a positive-displacement solid state pump 40 according to the present disclosure. In FIG. 3, positive-displacement solid state pump 40 is located within a casing conduit 32 that is defined by a casing 30 that extends within a wellbore 20. Casing 30 includes a plurality of perforations 36 that provide fluid communication between casing conduit 32 and a subterranean formation 16 that is present within a subsurface region 14. Positive-displacement solid state pump 40 is retained within a liquid discharge conduit 80 by a seat 34 and/or by a packer 42 and is configured to receive wellbore liquid 22 from casing conduit 32 and to generate pressurized wellbore liquid 24 therefrom.

As illustrated in FIG. 3, a wellbore gas 26 may flow within an annular space 79 within casing conduit 32. As illustrated, annular space 79 is defined between casing 30 and a tubing 78 that defines liquid discharge conduit 80. Annular space 79 also may be referred to herein as and/or may be a gas discharge conduit 79. As also illustrated in FIG. 3, a plurality of sensors 92 may detect a plurality of downhole process parameters at, or near, an inlet 66 to positive-displacement solid state pump 40 and/or at, or near, an outlet 67 from the positive-displacement solid state pump. A sand control structure 44 may restrict flow of sand from subterranean formation 16, into the positive-displacement solid state pump 40. In addition, a gas control structure 46 may restrict flow of wellbore gas 26 into the positive-displacement solid state pump.

FIG. 3 further illustrates that positive-displacement solid state pump 40 may include one or more first one-way check valves 69. First one-way check valves 69, positioned between the inlet port and the fluid chamber 64, may be configured to permit wellbore liquid 22 to enter a fluid chamber 64 of the positive-displacement solid state pump from wellbore 32. However, the one or more first one-way check valves 69, positioned between the inlet port and the fluid chamber 64, may resist, restrict, and/or block flow of pressurized wellbore liquid 24 therethrough and/or back into wellbore 32. This may permit creation of pressurized wellbore liquid 24 and/or pumping of pressurized wellbore liquid 24 from wellbore 32 via liquid discharge conduit 80.

As also illustrated in FIG. 3, positive-displacement solid state pump 40 further may include one or more second one-way check valves 68. Second one-way check valves 68, positioned between the outlet port and the fluid chamber 64, may be configured to permit pressurized wellbore liquid 24 to enter liquid discharge conduit 80 from fluid chamber 64 of positive-displacement solid state pump 40. However, the one or more second one-way check valves 68, which are positioned between the outlet port and the fluid chamber 64 may resist, restrict, and/or block flow of pressurized wellbore liquid 24 from liquid discharge conduit 80 into fluid chamber 64. This further may permit creation of pressurized wellbore liquid 24 and/or pumping of the pressurized wellbore liquid from wellbore 32 via liquid discharge conduit 80.

The one or more first one-way check valves 69, positioned between the inlet port and the fluid chamber 64, and/or the one or more second one-way check valves 68, positioned between the outlet port and the fluid chamber 64, may include any suitable structure. As illustrative, non-exclusive examples, first one-way check valve 69 and/or second one-way check valve 68 may include and/or be a mechanically actuated check valve and/or a check valve that is not electrically actuated. As a further illustrative, non-exclusive example, first one-way check valve 69 and/or second one-way check valve 68 may be an electrically actuated and/or electrically controlled check valve.

Fluid chamber 64 may define a volume that varies with a state of a solid state element 60 of positive-displacement solid state pump 40. Thus, fluid chamber 64 may define an expanded volume when the solid state element is in a contracted state, as schematically illustrated in solid lines in FIG. 3. Conversely, fluid chamber 64 may define a contracted volume when solid state element 60 is in an extended state, as schematically illustrated in dash-dot lines in FIG. 3. In addition, and as illustrated, the expanded volume may be greater than the contracted volume.

As illustrative, non-exclusive examples, the expanded volume may be at least 0.01 cubic centimeters, at least 0.1 cubic centimeters, at least 1 cubic centimeter, at least 5 cubic centimeters, at least 10 cubic centimeters, at least 20 cubic centimeters, at least 30 cubic centimeters, at least 40 cubic centimeters, at least 50 cubic centimeters, at least 60 cubic centimeters, at least 70 cubic centimeters, at least 80 cubic centimeters, at least 90 cubic centimeters, and/or at least 100 cubic centimeters greater than the contracted volume. Additionally or alternatively, the expanded volume also may be less than 400 cubic centimeters, less than 350 cubic centimeters, less than 300 cubic centimeters, less than 250 cubic centimeters, less than 200 cubic centimeters, less than 180 cubic centimeters, less than 160 cubic centimeters, less than 140 cubic centimeters, less than 120 cubic centimeters, and/or less than 100 cubic centimeters greater than the contracted volume. As further illustrative, non-exclusive examples, the expanded volume may be in a range defined by any combination of the preceding minimum and maximum values.

As illustrated in FIG. 3, positive-displacement solid state pump 40 further may include a housing 50. Housing 50 may at least partially define fluid chamber 64. Additionally or alternatively, solid state element 60 may be located at least partially within housing 50. In addition, and as discussed in more detail herein with reference to FIGS. 4-5, positive-displacement solid state pump 40 further may include a sealing structure 72 and/or an isolation structure 74.

Figure 4:
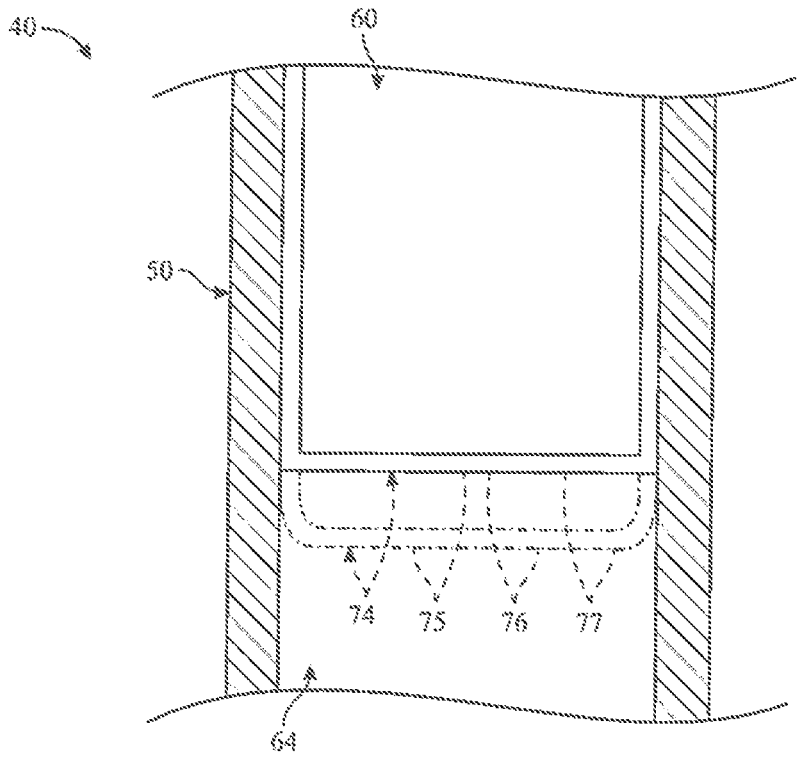
FIG. 4 is a fragmentary partial cross-sectional view of illustrative, non-exclusive examples of a positive-displacement solid state pump, according to the present disclosure.

FIG. 4 provides a further illustrative, non-exclusive example of a portion of a downhole piezoelectric pump 40, according to the present disclosure, that includes an isolation structure 74. Isolation structure 74 may be configured to fluidly isolate piezoelectric element 60 from compression chamber 64. This may include fluidly isolating the piezoelectric element from the compression chamber when the piezoelectric element is in the contracted state, as illustrated in solid lines in FIG. 4, as well as fluidly isolating the piezoelectric element from the compression chamber when the piezoelectric element is in the extended state, as illustrated in dash-dot lines in FIG. 4.

Isolation structure 74 may include any suitable structure. As illustrative, non-exclusive examples, isolation structure 74 may include and/or be a flexible isolation structure 75, a diaphragm 76, and/or an isolation coating 77.

Figure 5:
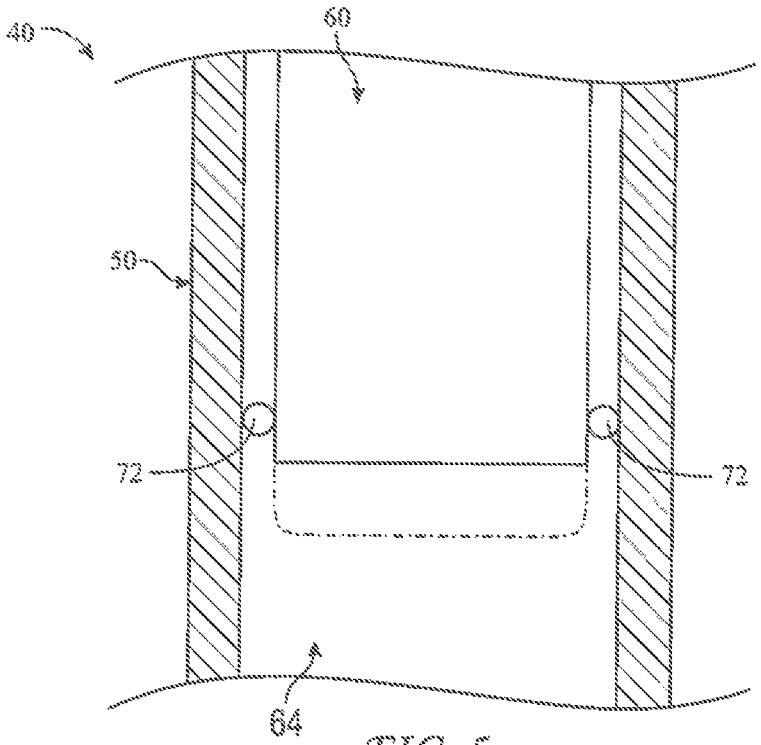
FIG. 5 is a fragmentary partial cross-sectional view of additional illustrative, non-exclusive examples of a positive-displacement solid state pump, according to the present disclosure.

FIG. 5 provides a further illustrative, non-exclusive example of a downhole piezoelectric pump 40 according to the present disclosure that includes a sealing structure 72. Sealing structure 72 may be configured to create a fluid seal between piezoelectric element 60 and housing 50 during (or despite) motion of piezoelectric element 60 and/or transitioning of the piezoelectric element between the contracted state, as illustrated in solid lines in FIG. 5, and the extended state (as illustrated in dash-dot lines in FIG. 5. Thus, sealing structure 72 may permit piezoelectric element 60 to transition between the extended state and the contracted state while restricting fluid flow from compression chamber 64 past the sealing structure.

Sealing structure 72 may include any suitable structure. As an illustrative, non-exclusive example, sealing structure 72 may include and/or be at least one O-ring.

Figure 6:
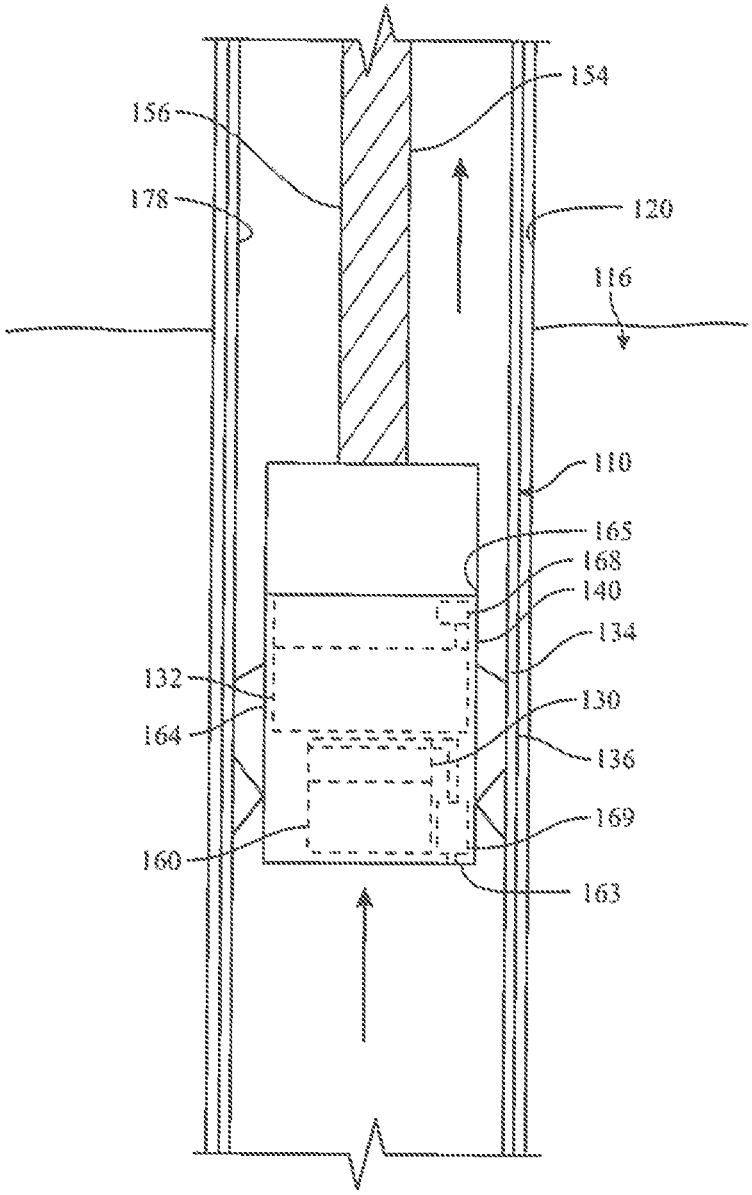
FIG. 6 is a fragmentary partial cross-sectional view of additional illustrative, non-exclusive examples of a positive-displacement solid state pump, according to the present disclosure.

Referring now to FIG. 6, a schematic representation of illustrative, non-exclusive examples of a system 110 for removing wellbore liquids from a wellbore 120, the wellbore 120 traversing a subterranean formation 116 and having a tubular 178 that extends within at least a portion of the wellbore 120, according the present disclosure is presented. The system 110 includes a positive-displacement solid state pump 140 comprising a fluid chamber 164, an inlet port 163 and an outlet port 165, each in fluid communication with the fluid chamber 164. At least one solid state element or actuator 160 is provided, together with a first one-way check valve 169 positioned between the inlet port 163 and the fluid chamber 164, and a second one-way check valve 168 positioned between the outlet port 165 and the fluid chamber 164. In some embodiments, the at least one solid state actuator 160 may be configured to operate at or near its resonance frequency. As shown, the solid state pump 140 is positioned within the wellbore 120.

A means for powering the solid state pump 154 is provided and may include any suitable structure that may be configured to provide the electric current to positive-displacement solid state pump 140, and/or to solid state element or actuator 160 thereof, and may be present in any suitable location. As an illustrative, non-exclusive example, means for powering the solid state pump 154 may be located in surface region, and electrical conduit 156 may extend between the means for powering the solid state pump and the positive-displacement solid state pump 140. Illustrative, non-exclusive examples of electrical conduit 156 include any suitable wire, power cable, wireline, and/or working line and electrical conduit 156 may connect to positive-displacement solid state pump 140 via any suitable electrical connection and/or wet-mate connection.

As another illustrative, non-exclusive example, means for powering the solid state pump 154 may include and/or be a rechargeable battery pack. The battery pack may be located within surface region, may be located within wellbore 120, and/or may be operatively and/or directly attached to positive-displacement solid state pump 140.

As indicated above, means for powering the solid state pump 154 may include and/or be a generator, an AC generator, a DC generator, a turbine, a solar-powered means for powering the solid state pump, a wind-powered means for powering the solid state pump, and/or a hydrocarbon-powered means for powering the solid state pump that may be located within surface region and/or within wellbore 120. When means for powering the solid state pump 154 is located within wellbore 120, the means for powering the solid state pump also may be referred to herein as a downhole power generation assembly. In some embodiments, the means for powering the solid state pump 154 is a power cable, the power cable operable for deploying the solid state pump 140. In some embodiments, the power cable comprises a synthetic conductor.

In some embodiments, the positive-displacement solid state pump may be plugged into a downhole wet-mate connection (not shown) and the means for powering the solid state pump 154, is a power cable positioned on the outside of the tubular 120.

As indicated, at least one solid state element or actuator 160 is provided. The at least one solid state actuator 160 may be selected from piezoelectric, electrostrictive and/or magnetorestrictive actuators. In some embodiments, the at least one solid state actuator 160 comprises a ceramic perovskite material. The ceramic perovskite material may comprise lead zirconate titanate and/or lead magnesium niobate. In some embodiments, the at least one solid state actuator 160 may comprise terbium dysprosium iron.

As shown in FIG. 6 and described above, a first one-way check valve 169 may be positioned between the inlet port 163 and the fluid chamber 164. Likewise, a second one-way e check valve 168 may be positioned between the outlet port 165 and the fluid chamber 164. In some embodiments, the first one-way check valve 169 and the second one-way check valve 168 are active microvalve arrays. In some embodiments, the first one-way check valve 169 and the second one-way check valve 168 are active MEMS valve arrays. In some embodiments, the first one-way check valve 169 and/or the second one-way check valve 168 are either passive one-way disc valves, active microvalve arrays, or active MEMS valve arrays, or a combination thereof.

In some embodiments, the solid state pump 140 includes a piston 130 and a cylinder 132 for housing the at least one solid state actuator 160 and the first and second one-way check valves, 169 and 168, respectively, so as to form a piston pump.

In some embodiments, the solid state pump 140 includes a diaphragm, described in more detail below, that is operatively associated with the at least one solid state actuator 160 and the first and second the one-way check valves, 169 and 168, respectively, so as to form a diaphragm pump.

In some embodiments, the system 110 may include a profile seating nipple 134 positioned within the tubular 178 for receiving the solid state pump 140. In some embodiments, the profile seating nipple 134 comprises a locking groove 136 structured and arranged to matingly engage the solid state pump 140.

Figure 7:
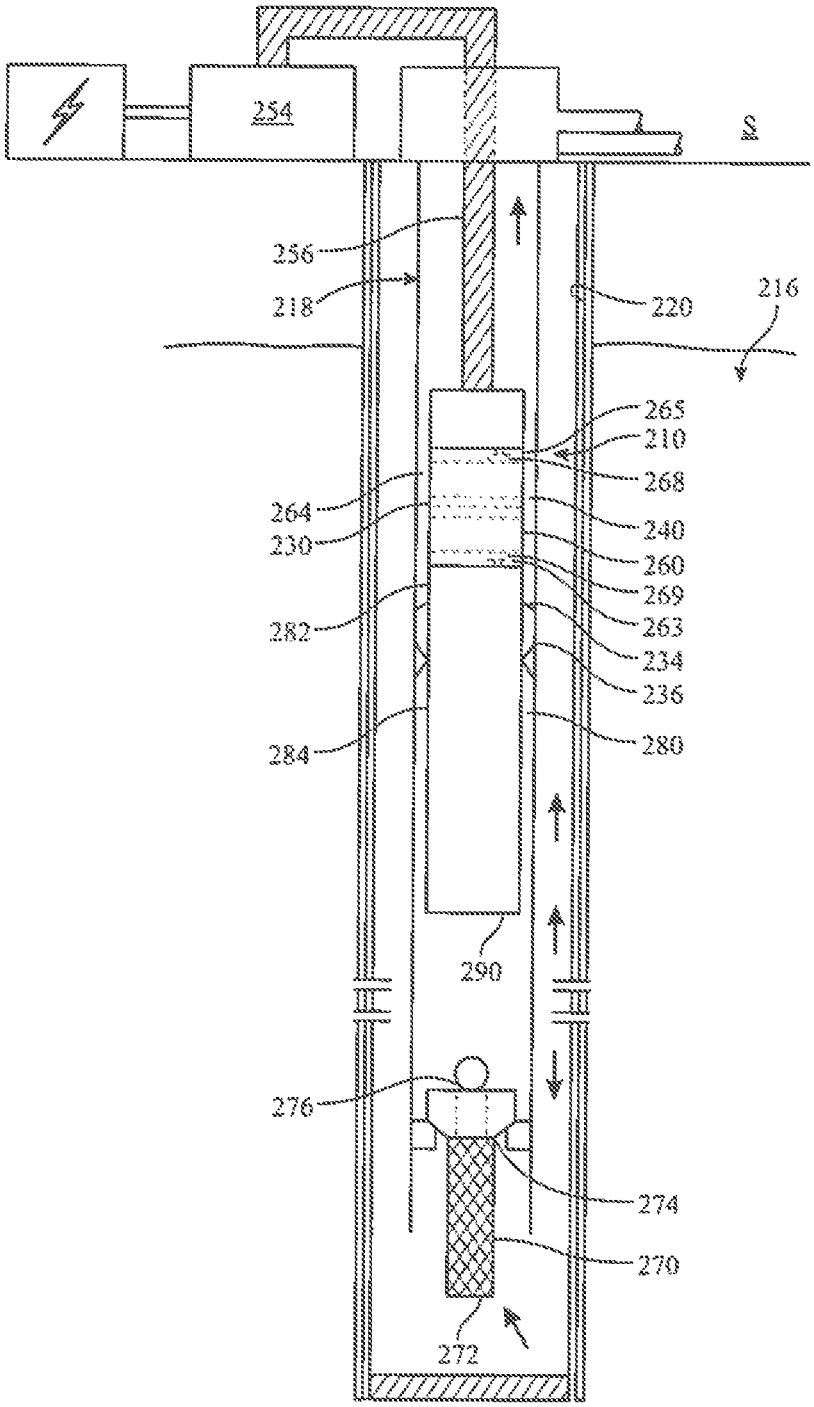
FIG. 7 is a schematic representation of illustrative, non-exclusive examples of a hydrocarbon well that may be utilized with and/or may include the systems and methods, according to the present disclosure.

As shown in FIG. 7, the system 110 of FIG. 6 may include a well screen or filter 270 in fluid communication with the inlet end 163 of the solid state pump 140, the well screen or filter 270 having an inlet end 272 and an outlet end 274. As shown in FIG. 7, a velocity fuse 276 may be positioned after the outlet end 274 of the well screen or filter 270. In some embodiments, the velocity fuse or standing valve 276 may be structured and arranged to back-flush the well screen or filter 270 and maintain a column of fluid within the tubular 178 in response to an increase in pressure drop across the velocity fuse 276.

Referring now to FIG. 7, another schematic representation of an illustrative, non-exclusive example of a system 210 for removing wellbore liquids from a wellbore 220, the wellbore 220 traversing a subterranean formation 216 and having a tubular 278 that extends within at least a portion of the wellbore 220, according the present disclosure is presented. The system 210 includes a positive-displacement solid state pump 240 comprising a fluid chamber 264, an inlet port 263 and an outlet port 265, each in fluid communication with the fluid chamber 264. At least one solid state element or actuator 260 is provided, together with a first one-way check valve 269 positioned between the inlet port 263 and the fluid chamber 264, and a second one-way check valve 268 positioned between the outlet port 265 and the fluid chamber 264. In some embodiments, the at least one solid state actuator 260 may be configured to operate at or near its resonance frequency. As shown, the solid state pump 240 positioned within the wellbore 220.

A means for powering the solid state pump 254 is provided and may include any suitable structure that may be configured to provide the electric current to positive-displacement solid state pump 240, and/or to solid state element or actuator 260 thereof, and may be present in any suitable location.

The system 210 further includes at least one secondary pump 280 for transferring the wellbore liquids from the wellbore 220. In the configuration of FIG. 7, the inlet port 263 and the outlet port 265 of the positive-displacement solid state pump 240 are operatively connected to a hydraulic system 282 to drive the at least one secondary pump 284 and form a pump assembly 284.

In some embodiments, the at least one secondary pump 280 may comprise a bladder pump. In some embodiments, the at least one secondary pump 280 may comprise a centrifugal pump. In some embodiments, the at least one secondary pump 280 may comprise a rotary screw pump and/or a rotary lobe pump. In some embodiments, the at least one secondary pump 280 may comprise a gerotor pump and/or a progressive cavity pump. In some embodiments, the bladder pump is a metal bellows pump or an elastomer pump.

As an illustrative, non-exclusive example, means for powering the solid state pump 254 may be located in surface region S, and electrical conduit 256 may extend between the means for powering the solid state pump 254 and the positive-displacement solid state pump 240. Illustrative, non-exclusive examples of electrical conduit 256 include any suitable wire, power cable, wireline, and/or working line, and electrical conduit 256 may connect to positive-displacement solid state pump 240 via any suitable electrical connection and/or wet-mate connection.

As another illustrative, non-exclusive example, means for powering the solid state pump 254 may include and/or be a rechargeable battery pack. The battery pack may be located within surface region, may be located within wellbore 220, and/or may be operatively and/or directly attached to positive-displacement solid state pump 240.

As indicated above, means for powering the solid state pump 254 may include and/or be a generator, an AC generator, a DC generator, a turbine, a solar-powered means for powering the solid state pump, a wind-powered means for powering the solid state pump, and/or a hydrocarbon-powered means for powering the solid state pump that may be located within surface region S and/or within wellbore 220. When means for powering the solid state pump 254 is located within wellbore 220, the means for powering the solid state pump also may be referred to herein as a downhole power generation assembly. In some embodiments, the means for powering the solid state pump 254 is a power cable 256, the power cable operable for deploying the solid state pump 240. In some embodiments, the power cable 256 comprises a synthetic conductor.

In some embodiments, the positive-displacement solid state pump 240 may be plugged into a downhole wet-mate connection (not shown) and the means for powering the solid state pump 254, is a power cable positioned on the outside of the tubular 220.

As indicated above, at least one solid state element or actuator 260 is provided. The at least one solid state actuator 260 may be selected from piezoelectric, electrostrictive and/or magnetorestrictive actuators. In some embodiments, the at least one solid state actuator 260 comprises a ceramic perovskite material. The ceramic perovskite material may comprise lead zirconate titanate and/or lead magnesium niobate. In some embodiments, the at least one solid state actuator 260 may comprise terbium dysprosium iron.

A first one-way check valve 269 may be positioned between the inlet port 263 and the fluid chamber 264. Likewise, a second one-way check valve 268 may be positioned between the outlet port 265 and the fluid chamber 264. In some embodiments, the first one-way check valve 269 and the second one-way check valve 268 are active microvalve arrays. In some embodiments, the first one-way check valve 269 and the second one-way check valve 268 are active MEMS valve arrays. In some embodiments, the first one-way check valve 269 and/or the second one-way check valve 268 are either passive one-way disc valves, active microvalve arrays, or active MEMS valve array, or a combination thereof.

In some embodiments, the solid state pump 240 includes a diaphragm 230, described in more detail below, that is operatively associated with the at least one solid state actuator 260 and the first and second the one-way check valves, 269 and 268, respectively, so as to form a diaphragm pump.

As shown in the example of FIG. 6, in some embodiments, the solid state pump 240 may include a piston and a cylinder for housing the at least one solid state actuator and the first and second one-way check valves, so as to form a piston pump.

In some embodiments, the system 210 may include a profile seating nipple 234 positioned within the tubular 220 for receiving the solid state pump 240. In some embodiments, the profile seating nipple 234 comprises a locking groove 236 structured and arranged to matingly engage the pump assembly 284.

The system 210 may include a well screen or filter 270 in fluid communication with the inlet end 290 of the pump assembly 284, the well screen or filter 270 having an inlet end 272 and an outlet end 274. As shown, a velocity fuse or standing valve 276 may be positioned after the outlet end 274 of the well screen or filter 270. In some embodiments, the velocity fuse 276 may be structured and arranged to back-flush the well screen or filter 270 and maintain a column of fluid within the tubular 278 in response to an increase in pressure drop across the velocity fuse 276.

Suitable velocity fuses are commercially available from a variety of sources, including the Hydraulic Valve Division of Parker Hannifin Corporation, Elyria, Ohio, USA, and Vonberg Valve, Inc., Rolling Meadows, Ill., USA. In particular, two sizes of commercially available velocity fuses are expected to have utility in the practice of the present disclosure. These are: a velocity fuse having a 1" OD, with a flow range of 11 liters/minute (3 GPM) to 102 liters/minute (27 GPM), and a velocity of having a 1.5" OD, with a flow range of: 23 liters/minute (6 GPM) to 227 liters/minute (60 GPM). Each of these commercially available velocity sleeves have a maximum working pressure of 5,000 psi and a temperature ratings of −20 F to +350 F (−27 C to +177 C). The body and sleeve are made of brass, and the poppet, roll pin, and spring are made of stainless steel. O-rings are both nitrile and PTFE. Custom-built velocity fuses are envisioned and may provide a higher pressure rated device, if needed, which may be incorporated into a housing for seating in the no-go profile nipple.

Figure 8:
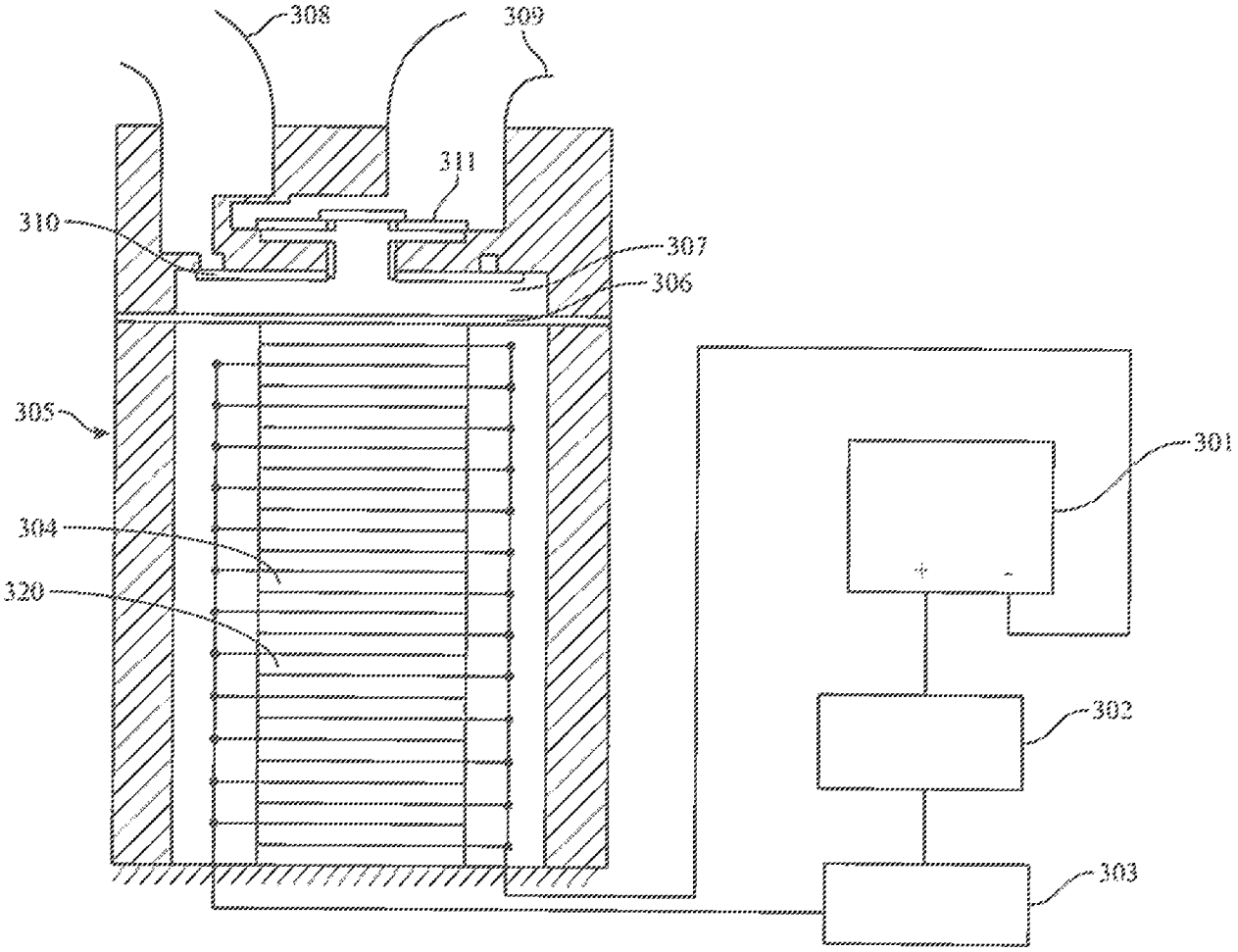
FIGS. 8-10 present schematic representations of illustrative, non-exclusive examples of a positive-displacement solid state pump, according to the present disclosure.
Figure 10:
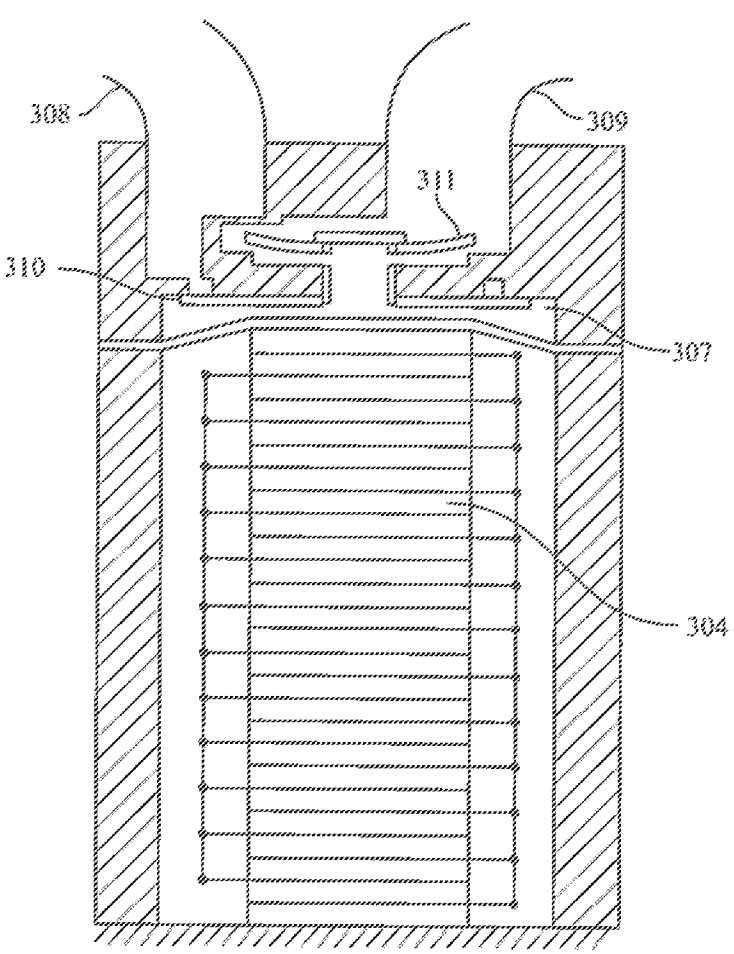
Figure 9:
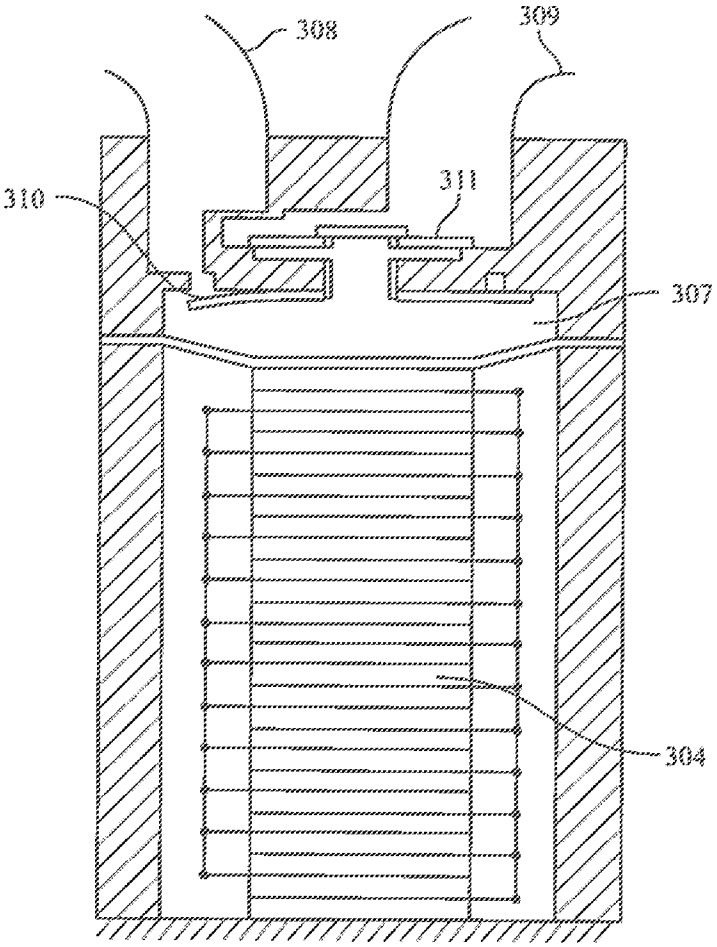

Referring now to FIGS. 8-10, one embodiment of a positive-displacement solid state pump 305, in accordance herewith, is presented. As shown in FIG. 8, a power source 301, which may be an AC power source, provides power to at least one solid state actuator, 304 of positive-displacement solid state pump 305. A frequency modulator 302 and an amplitude modulator 303 may be connected in series, as shown, and can be adjusted to vary the frequency and amplitude of the signal reaching at least one solid state actuator 304. In some embodiments, the at least one solid state actuator 304 is selected from piezoelectric, electrostrictive and/or magnetorestrictive actuators. In some embodiments, the at least one solid state actuator 304 is a piezoelectric actuator 320.

In some embodiments, a diaphragm 306 is bonded to the top of piezoelectric actuator 320 and separates piezoelectric actuator 320 from fluid chamber 307. A first one-way passive disc valve 310 controls the flow of fluid through inlet port 308 into fluid chamber 307. Likewise, a second one-way passive disc valve 311 controls the flow of fluid leaving fluid chamber 307 through outlet port 309. Suitable passive one-way disc valves are available from Kinetic Ceramics, Inc. of Hayward, Calif. Such passive one-way disc valves may fabricated from metal.

Referring to FIGS. 8 and 9, in operation, as voltage is applied to piezoelectric actuator 320 via power source 301, piezoelectric actuator 320 will expand and contract in response to the signal, causing diaphragm 306 to bend up and down in a piston-like fashion. When diaphragm 306 bend downwards, fluid chamber 307 expands, as those skilled in the art would plainly understand. The expanding of the size of fluid chamber 307 causes a corresponding drop in pressure inside fluid chamber 307. When the pressure inside fluid chamber 307 becomes less than the pressure inside fluid inlet port 308, first one-way passive disc valve 310 will open permitting the flow of fluid into fluid chamber 307. When the pressure inside fluid chamber 307 becomes less than the pressure inside fluid outlet port 309, the second one-way passive disc valve 311 will close preventing a back flow of fluid from outlet port 309 into fluid chamber 307.

Referring to FIGS. 8 and 10, when diaphragm 306 bends upwards, the size of fluid chamber 307 decreases. The decreasing of the size of fluid chamber 307 causes a corresponding increase in pressure inside fluid chamber 307. When the pressure inside fluid chamber 307 becomes greater than the pressure inside fluid outlet port 309, second one-way passive disc valve 311 will open permitting the flow of fluid out of fluid chamber 307. When the pressure inside fluid chamber 307 becomes greater than the pressure inside fluid inlet port 308, first one-way passive disc valve 310 will close preventing a back flow of fluid from fluid chamber 307 into inlet port 308. In this fashion, positive-displacement solid state pump 305 will continue to pump fluid from inlet port 308 to outlet port 309 until power source 301 is removed.

Figure 11A:
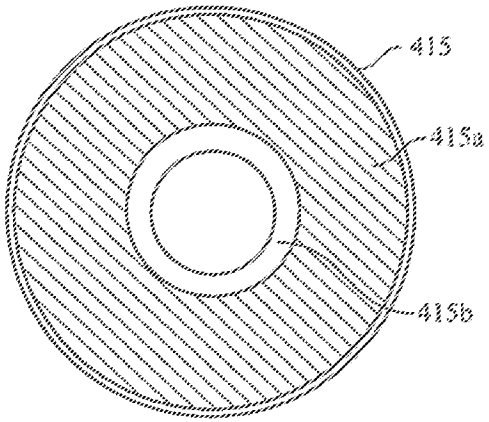
FIG. 11A shows a preferred active disc.
Figure 11:
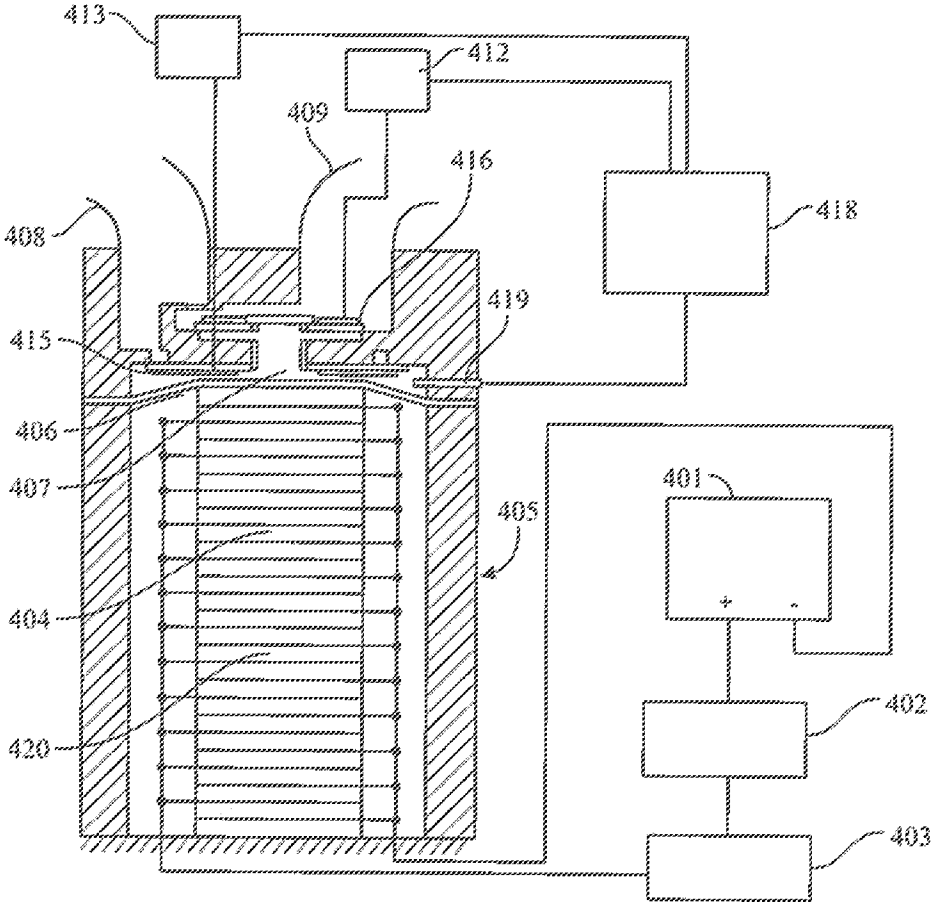
FIG. 11 presents a schematic representation of an illustrative, non-exclusive examples of a positive-displacement solid state pump, according to the present disclosure.
Figure 13:
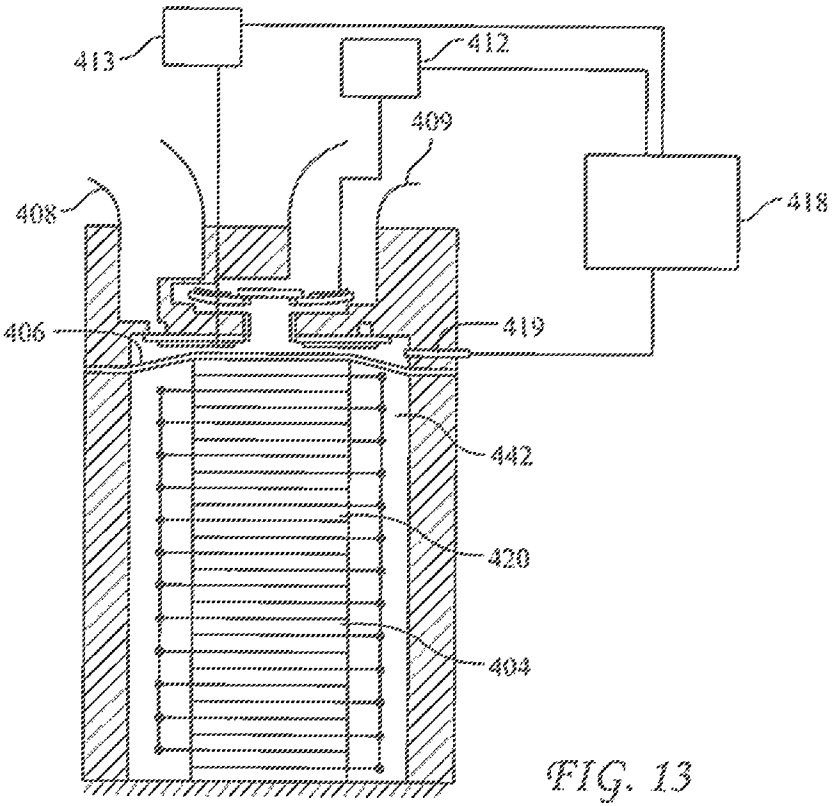
FIGS. 12-13 illustrate the operation of the positive-displacement solid state pump of FIG. 11.
Figure 12:
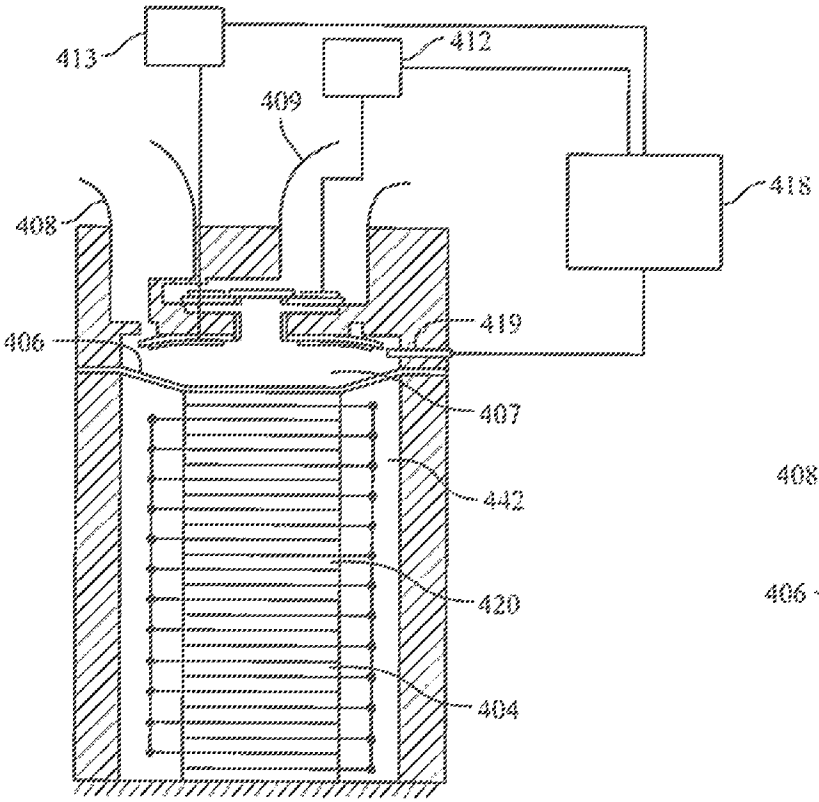

Referring now to FIGS. 11-13, another embodiment of a positive-displacement solid state pump 405, in accordance herewith, is presented. As shown in FIG. 11, first one-way active disc valve 415 and second one-way active disc valve 416 have replaced first one-way passive disc valve 310 and second one-way active disc valve 311 of the FIG. 8 embodiment. First one-way active disc valve 415 and second one-way active disc valve 416 are electrically connected to power sources 412 and 413 as to open and close based on electrical signals.

As shown in FIG. 11, a power source 401, which may be an AC power source, provides power to at least one solid state actuator, 404 of positive-displacement solid state pump 405. A frequency modulator 402 and an amplitude modulator 403 may be connected in series, as shown, and can be adjusted to vary the frequency and amplitude of the signal reaching at least one solid state actuator 404. In some embodiments, the at least one solid state actuator 404 is selected from piezoelectric, electrostrictive and/or magnetorestrictive actuators. In some embodiments, the at least one solid state actuator 404 is a piezoelectric actuator 420. In some embodiments, a diaphragm 406 is bonded to the top of piezoelectric actuator 420 and separates piezoelectric actuator 420 from fluid chamber 407.

FIG. 11A shows a top view of first active disc valve 415. Piezoelectric actuator 415*a* is bonded to the top of a metal disc valve 415*b*. Piezoelectric actuator 415*a* utilizes the d31 piezoelectric mode of operation (d31 describes the strain perpendicular to the polarization vector of the ceramics). In operation, when no electricity has been applied to the piezoelectric actuator 415*a*, metal disc valve 415*b* will seal flow inlet port 408. When electricity has been applied to piezoelectric actuator 415*a*, it contracts, causing metal disc valve 415*b* to bend, thereby breaking the seal over inlet port 408. Fluid can now flow through the first active disc valve 415.

Referring again to FIG. 11, the voltage output of power source 401 is at a maximum. Second one-way active disc valve 416 is closing in response to power source 412 and first one-way active disc valve 415 is opening in response to power source 413.

In FIG. 12, the voltage output of power source 401 is a negative sine function. Voltage from power source 401 has caused piezoelectric actuator 420 to contract bending diaphragm 406 downward resulting in a pressure drop in fluid chamber 407. Pressure sensor 419 has sensed a decrease in pressure inside fluid chamber 407 and has sent a signal to microprocessor 418. Microprocessor 418 has sent a control signal to power sources 412 and 413 causing them to transmit control voltages to first one-way active disc valve 415 and second one-way active disc valve 416, respectively. The positive voltage from power source 413 has caused first one-way active disc valve 415 to open and the negative voltage from power source 412 has caused second one-way active disc valve 416 to remain closed. Fluid from inlet port 408 has entered pumping chamber 407.

In FIG. 13, the voltage output of power source 401 is a positive going sine function, causing piezoelectric actuator 420 to expand bending diaphragm 406 upward and resulting in a pressure increase in fluid chamber 407. Pressure sensor 419 has sensed an increase in pressure inside pumping chamber 407 and has sent a signal to microprocessor 418. Microprocessor 418 has sent control signals to power sources 412 and 413 causing them to transmit control voltages to second one-way active disc valve 416, and first one-way active disc valve 415, respectively. The negative voltage from power source 413 has caused first one-way active disc valve 415 to close and the positive voltage from power source 412 has caused second one-way active disc valve 416 to open. Fluid from pumping chamber 407 has entered outlet port 409.

When the voltage output of power source 401 is again at a maximum and piezoelectric actuator 420 is at a fully expanded condition, as shown in FIG. 11, first one-way active disc valve 415 is opening in response to power source 413 and second one-way active disc valve 416 is closing in response to power source 412 preventing fluid from flowing back to fluid chamber 407 through second one-way active disc valve 416. In this fashion, positive-displacement solid state pump 405 will continue to pump fluid from inlet port 408 to outlet port 409 until power sources 401, 412, and 413 are removed.

Due to the fast response of the active disc valves, the piezoelectric actuator 420 can be cycled faster than it could with the passive disc valve. This will allow for more pump strokes per second and an increase in pump output.

Figure 15:
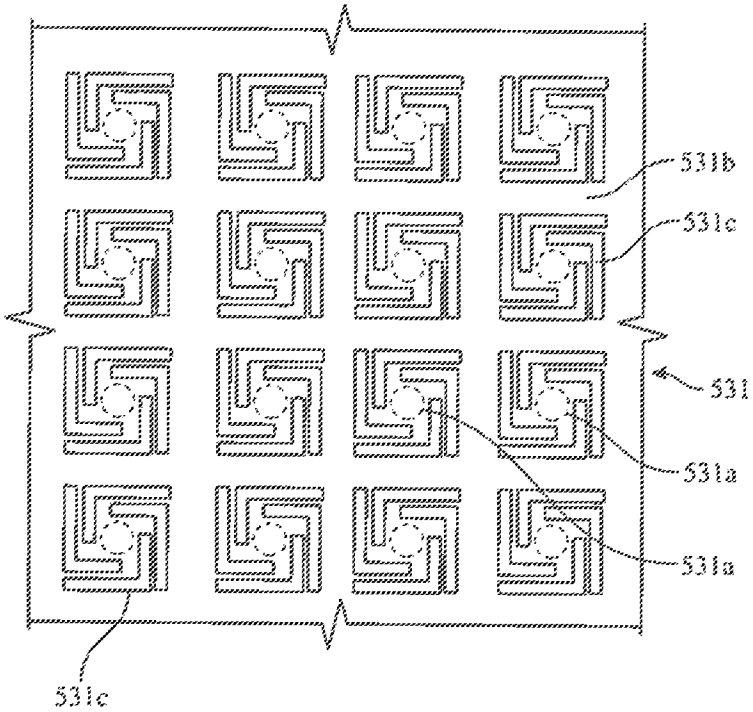
FIGS. 14-15 shows further schematic representations of illustrative, non-exclusive examples of a positive-displacement solid state pump, according to the present disclosure.
Figure 14:
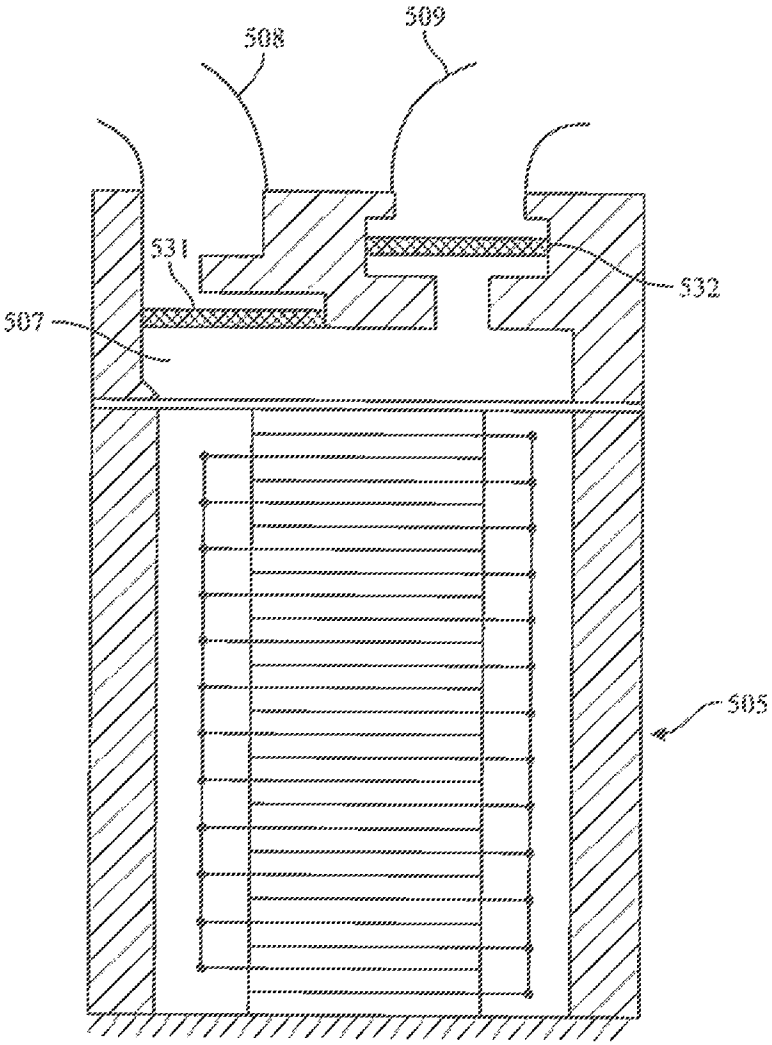

Referring now to FIGS. 14 and 15, another embodiment of a positive-displacement solid state pump 505, in accordance herewith, is presented. This embodiment utilizes two passive micro-electromechanical system (MEMS) valve arrays. Positive-displacement solid state pump 505 is similar to pump 305 shown in FIG. 8, with the exception that first one-way passive disc valve 310 and second one-way passive disc valve 311 of pump 305 have been replaced with a first one-way passive microvalve array 531 and a second one-way passive microvalve array 532, as shown in FIG. 14. Preferably, microvalve arrays 531 and 532 are two micro machined MEMS valves.

Referring now to FIG. 15, microvalve array 531 is fabricated from silicon, silicone nitride or nickel and includes an array of fluid flow ports 531*a* approximately 200 microns in diameter. The array of fluid flow ports 531*a* is covered by diaphragm layer 531*b*. FIG. 15 shows an enlarged top view of a cutout portion of microvalve array 531. Microvalve array 531 has a plurality of diaphragms 531*c* covering each fluid flow port 531*a*.

In operation, first one-way passive microvalve array 531 and second one-way passive microvalve array 532 function in a fashion similar to passive disc valves 310 and 311 of FIG. 8. In FIG. 15, the pressure pressing downward on diaphragm 531*c* is greater than the pressure of fluid inside fluid flow port 531*a*. Therefore, diaphragm 531*c* seals fluid flow port 531*a*. Conversely, the pressure pressing downward on diaphragm 531*c* is less than the pressure of fluid inside fluid flow port 531*a*. Therefore, diaphragm 531*c* is forced open and fluid flows through fluid flow port 531*a*.

Referring again to FIG. 14, when the pressure inside fluid chamber 507 becomes less than the pressure inside fluid inlet port 508, individual valves within the multitude of microvalves in microvalve array 531 will open permitting the flow of fluid into fluid chamber 507. When the pressure inside fluid chamber 507 becomes less than the pressure inside fluid outlet port 509, the individual valves within the multitude of micro valves in the microvalve array 532 will close preventing a back flow of fluid from outlet port 509 into fluid chamber 507.

Likewise, when the pressure inside fluid chamber 507 becomes greater than the pressure inside fluid outlet port 509, the individual valves within the multitude of micro valves in microvalve array 532 will open permitting the flow of fluid into outlet port 509. When the pressure inside fluid chamber 507 becomes greater than the pressure inside fluid inlet port 508, the individual valves within the multitude of micro valves in microvalve array 531 will close preventing a back flow of fluid from fluid chamber 507 into inlet port 508.

Due to its small size and low inertia, the microvalve array can respond quickly to pressure changes. Therefore, the pump output may be increased because it can cycle faster than it could with a more massive valve.

Figure 17:
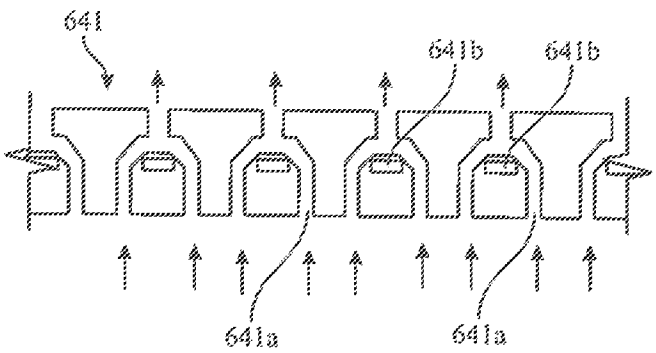
FIGS. 16-18 shows another set of schematic representations of illustrative, non-exclusive examples of a positive-displacement solid state pump, according to the present disclosure.
Figure 18:
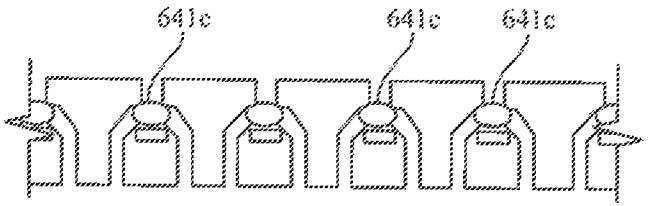
Figure 16:
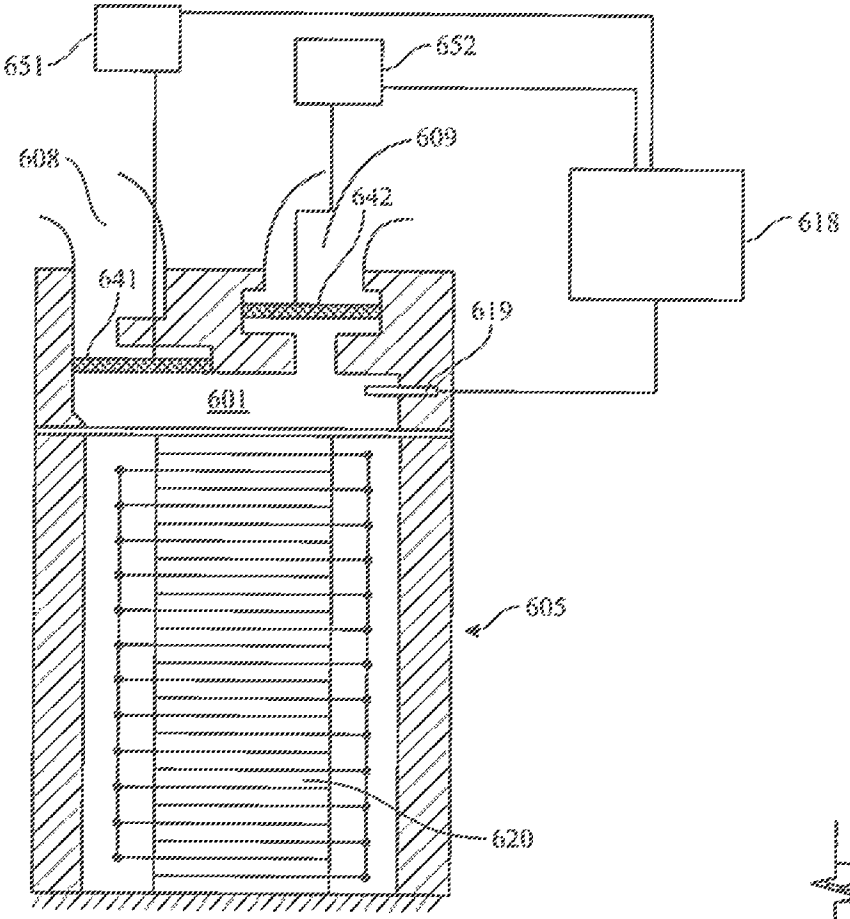

Referring now to FIGS. 16-18, another embodiment of a positive-displacement solid state pump 605, in accordance herewith, is presented. This embodiment is similar to the embodiment described above in reference to FIGS. 11 and 11A, with the exception that first one-way active disc valve 415 and second one-way active disc valve 416 of FIG. 11 are replaced with first one-way active microvalve array 641 and second one-way active microvalve array 642.

FIG. 17 shows an enlarged side view of first one-way active microvalve array 641. First one-way active microvalve array 641 is fabricated from silicon and includes an array of "Y" shaped fluid flow ports 641*a*, approximately 200 microns in diameter. In some embodiments, second one-way active microvalve array 642 may be identical to first one-way active microvalve array 641. Below the junction of each "Y" are heaters 641*b*. Heaters 641*b* for first one-way active microvalve array 641 are electrically connected to power source 651 and heaters 641*b* for second one-way active microvalve array 642 are electrically connected to power source 652. Pressure sensor 619 senses the pressure inside fluid chamber 607 and sends a corresponding signal to microprocessor 618. Microprocessor 618 is configured to send control signals to power sources 651 and 652.

In operation, first one-way active microvalve array 641 and second one-way active microvalve array 642 function in a fashion similar to first one-way active disc valve 415 and second one-way active disc valve 416 of FIG. 11. For example, in FIG. 17, first one-way active microvalve array 641 is open. Fluid is able to flow freely through fluid flow ports 641*a*. In FIG. 18, first one-way active microvalve array 641 is closed. Power source 651 has sent voltage to heaters 641*b* of first one-way active microvalve array 641. Heaters 641*b* have heated the adjacent fluid causing a phase change to a vapor phase and the formation of high pressure bubbles 641*c*. High pressure bubbles 41 *c* block fluid flow ports 641*a* for a short time closing first one-way active microvalve array 641. The lack of mass or inertia due to there being no valve diaphragm permits very fast response which enables the valves to open and close at high a frequency beyond 100 kHz.

When piezoelectric actuator 620 contracts and the pressure inside fluid chamber 607 becomes less than the pressure inside fluid inlet port 608, pressure sensor 619 will send a corresponding signal to microprocessor 618. Microprocessor 618 will then send a control signal to power sources 651 and 652. Consequently, individual valves within the multitude of microvalves in first one-way active microvalve array 641 will open permitting the flow of fluid into fluid chamber 607 (FIG. 17). Also, individual valves within the multitude of micro valves in the second one-way active microvalve array 642 will close (FIG. 18) preventing a back flow of fluid from outlet port 609 into fluid chamber 607.

Likewise, when piezoelectric actuator 620 expands and the pressure inside fluid chamber 607 becomes greater than the pressure inside fluid outlet port 609, pressure sensor 619 will send a corresponding signal to microprocessor 618. Microprocessor 618 will then send control signals to power sources 651 and 652. Consequently, the individual valves within the multitude of micro valves in second one-way active microvalve array 642 will open permitting the flow of fluid into outlet port 609. Also, the individual valves within the multitude of micro valves in first one-way active microvalve array 641 will close preventing a back flow of fluid from fluid chamber 607 into inlet port 608. Due to its ability to anticipate the need to open and close, the active microvalve array can respond very quickly. Hence, the pump can cycle faster and pump output is increased.

In some embodiments, at certain frequencies generated by the power source, piezoelectric actuator 320, 420, 520, 620 will resonate. As piezoelectric actuator 320, 420, 520, 620 resonates, the amount of electrical energy required to piezoelectric actuator 320, 420, 520, 620 by a given amount will decrease. Therefore, the efficiency of the piezoelectric pump will be increased.

Any electromechanical spring/mass system (including piezoelectric actuator 320, 420, 520, 620) will resonate at certain frequencies. The "primary" or "first harmonic" frequency is the preferred frequency. In some embodiments, the power source sends an electrical drive signal to the piezoelectric actuator 320, 420, 520, 620 at or near the primary resonant frequency. That frequency is calculated by using the mass and modulus of elasticity for the piezoelectric actuator 320, 420, 520, 620: $f=(k/m)^{1/2}$ where m is the mass of the resonant system and k is the spring rate (derived from the modulus of elasticity). When in resonance, the amplitude of the motion will increase by a factor of 4 or 5.

Thus for a given pump stoke, the drive voltage and electrical input power can be reduced by a similar factor.

Figure 19:
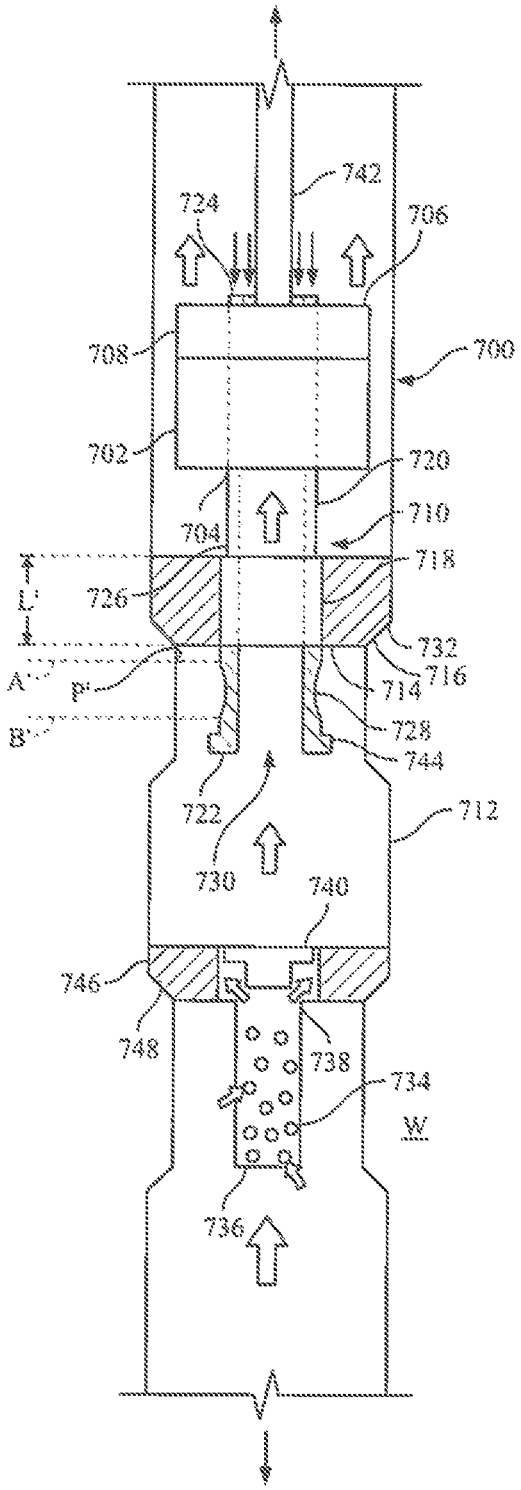
FIG. 19 presents a cross-sectional view of an illustrative, nonexclusive example of a velocity fuse having utility in the flushable well screen or filter assemblies of the present disclosure.

Referring now to FIG. 19, a schematic view of an illustrative, nonexclusive example of a system for 700 removing fluids from a well, according to the present disclosure is presented. As shown, the system 700 may include an apparatus 710 for reducing the force required to pull a positive-displacement solid state pump 702 from a tubular 712. The system 700 includes the positive-displacement solid state pump 702 having an inlet end 704 and a discharge end 706. A telemetry section 708 is operatively connected to the positive-displacement solid state pump 702.

As shown, the apparatus 710 may be positioned upstream of the pump 702. Apparatus 710 includes a tubular sealing device 714 for mating with a downhole tubular component 716, the tubular sealing device 714 having an axial length L' and a longitudinal bore 718 therethrough.

Apparatus 710 also includes an elongated rod 720, slidably positionable within the longitudinal bore 718 of the tubular sealing device 714. The elongated rod 720 includes a first end 722, a second end 724, and an outer surface 726. As shown in FIG. 19, the outer surface 726 is structured and arranged to provide a hydraulic seal when the elongated rod is in a first position (when position A' is aligned with point P') within the longitudinal bore 718 of the tubular sealing device 714. Also, as shown in FIG. 19, the outer surface 726 of elongated rod 720 is structured and arranged to provide at least one external flow port 728 for pressure equalization upstream and downstream of the tubular sealing device 714 when the elongated rod 720 is placed in a second position (when position B' is aligned with point P') within the longitudinal bore 718 of the tubular sealing device 714.

In some embodiments, the elongated rod 720 includes an axial flow passage 730 extending therethrough, the axial flow passage in fluid communication with the positive-displacement solid state pump 702.

In some embodiments, the tubular sealing device 714 is structured and arranged for landing within a nipple profile (not shown) or for attaching to a collar stop 732 for landing directly within the tubular 712.

In some embodiments, a well screen or filter 734 is provided, the well screen or filter 734 in fluid communication with the inlet end 704 of the positive-displacement solid state pump 702, the well screen or filter 734 having an inlet end 736 and an outlet end 738.

In some embodiments, a velocity fuse or standing valve 740 is positioned between the outlet end 738 of the well screen or filter 134 and the first end 122 of the elongated rod 720. As shown, the velocity fuse or standing valve 740 is in fluid communication with the well screen or filter 734.

In some embodiments, the velocity fuse 740 is structured and arranged to back-flush the well screen or filter 734 and maintain a column of fluid within the tubular 712 in response to an increase in pressure drop across the velocity fuse 740. In some embodiments, the velocity fuse 740 is normally open and comprises a spring-loaded piston responsive to changes in pressure drop across the velocity fuse 740.

In some embodiments, the apparatus 710 is structured and arranged to be installed and retrieved from the tubular 712 by a wireline or a coiled tubing 742. In some embodiments, the apparatus 710 is integral to the tubing string.

In some embodiments, the first end 722 of the elongated rod 720 includes an extension 744 for applying a jarring force to the tubular sealing device 714 to assist in the removal thereof.

In some embodiments, the velocity fuse or standing valve 740 may be installed within a housing 146. In some embodiments, the housing 746 is structured and arranged for sealingly engaging the tubular 712. In some embodiments, the housing 746 comprises at least one seal 748. In some embodiments, the housing 746 may be configured to seat within a tubular 712, as shown.

Figure 20:
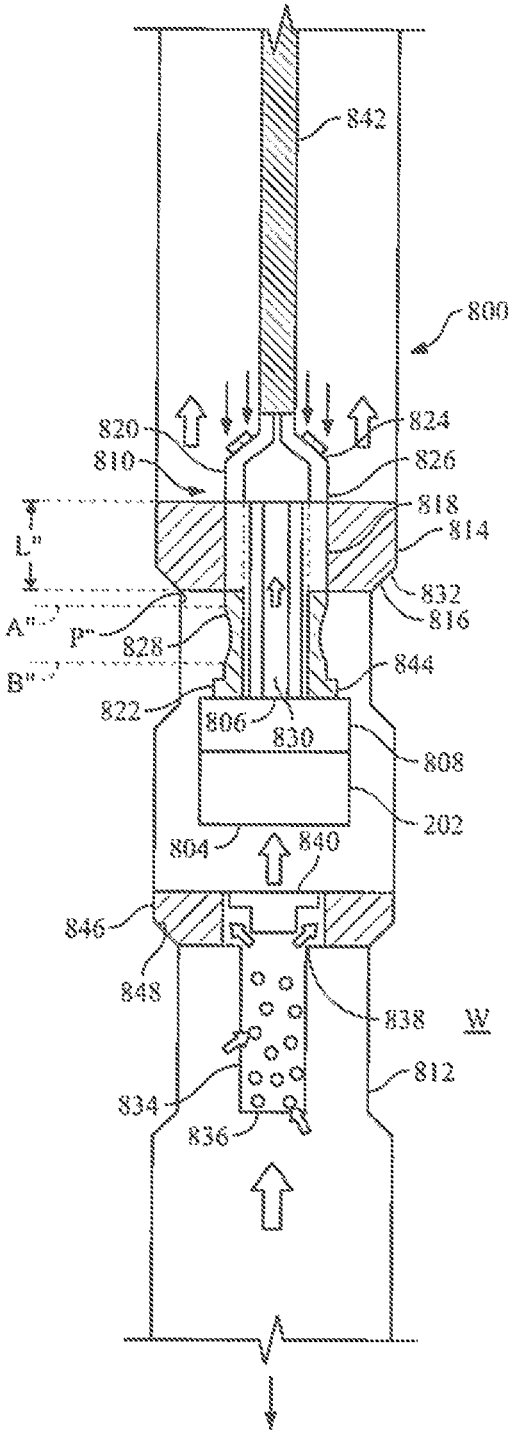
FIG. 20 presents a schematic view of an illustrative, nonexclusive example of a system for removing fluids from a well, according to the present disclosure.

Referring now to FIG. 20, a schematic view of an illustrative, nonexclusive example of a system for 800 removing fluids from a well, according to the present disclosure is presented. The system 800 includes a positive-displacement solid state pump 802 having an inlet end 804 and a discharge end 806. A telemetry section 808 is operatively connected to the positive-displacement solid state pump 802.

The system 800 also includes an apparatus 810 for reducing the force required to pull the pump 802 from a tubular 812. As shown, the apparatus 810 may be positioned downstream of the pump 802. Apparatus 810 includes a tubular sealing device 814 for mating with a downhole tubular component 816, the tubular sealing device 814 having an axial length L" and a longitudinal bore 818 therethrough.

Apparatus 810 also includes an elongated rod 820, slidably positionable within the longitudinal bore 818 of the tubular sealing device 814. The elongated rod 820 includes a first end 822, a second end 824, and an outer surface 826. As shown in FIG. 20, the outer surface 826 is structured and arranged to provide a hydraulic seal when the elongated rod is in a first position (when position A" is aligned with point P") within the longitudinal bore 818 of the tubular sealing device 814. Also, as shown in FIG. 20, the outer surface 826 of elongated rod 820 is structured and arranged to provide at least one external flow port 828 for pressure equalization upstream and downstream of the tubular sealing device 814 when the elongated rod 820 is placed in a second position (when position B" is aligned with point P") within the longitudinal bore 818 of the tubular sealing device 814.

In some embodiments, the elongated rod 820 includes an axial flow passage 830 extending therethrough, the axial flow passage in fluid communication with the positive-displacement solid state pump 802.

In some embodiments, the tubular sealing device 814 is structured and arranged for landing within a nipple profile (not shown) or for attaching to a collar stop 832 for landing directly within the tubular 812.

In some embodiments, a well screen or filter 834 is provided, the well screen or filter 834 in fluid communication with the inlet end 804 of the positive-displacement solid state pump 802, the well screen or filter 834 having an inlet end 836 and an outlet end 838.

In some embodiments, a velocity fuse or standing valve 840 is positioned between the outlet end 838 of the well screen or filter 834 and the first end 822 of the elongated rod 820. As shown, the velocity fuse or standing valve 840 is in fluid communication with the well screen or filter 834.

In some embodiments, the velocity fuse 840 is structured and arranged to back-flush the well screen or filter 832 and maintain a column of fluid within the tubular 812 in response to an increase in pressure drop across the velocity fuse 840. In some embodiments, the velocity fuse 840 is normally open and comprises a spring-loaded piston responsive to changes in pressure drop across the velocity fuse 840.

In some embodiments, the apparatus 810 is structured and arranged to be installed and retrieved from the tubular 812 by a wireline or a coiled tubing 842. In some embodiments, the apparatus 810 is integral to the tubing string.

In some embodiments, the first end 822 of the elongated rod 820 includes an extension 844 for applying a jarring force to the tubular sealing device 814 to assist in the removal thereof.

In some embodiments, the velocity fuse or standing valve 840 may be installed within a housing 846. In some embodiments, the housing 846 is structured and arranged for sealingly engaging the tubular 812. In some embodiments, the housing 846 comprises at least one seal 848. In some embodiments, the housing 846 may be configured to seat within a tubular 812, as shown.

Figure 21:
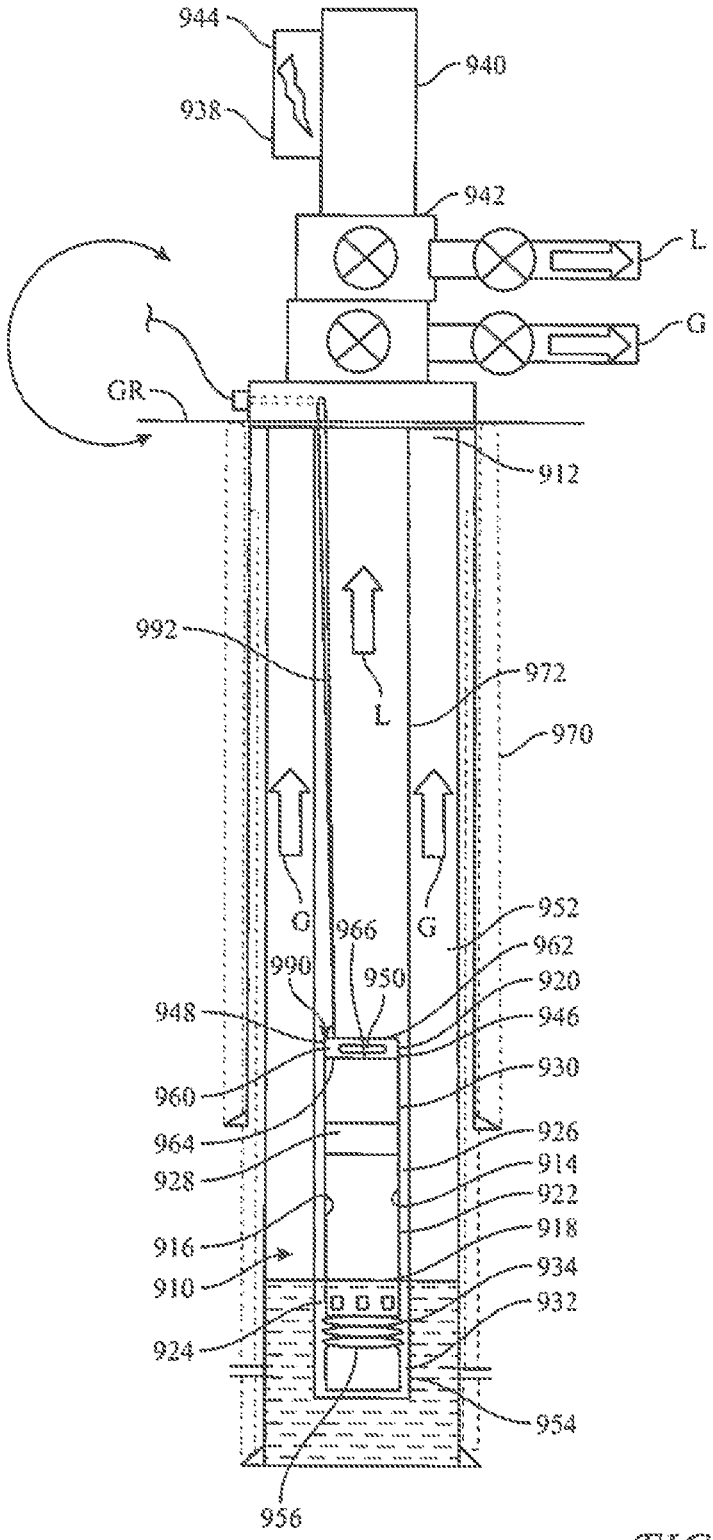
FIG. 21 presents a schematic view of an illustrative, nonexclusive example of a system for removing fluids from a subterranean well, depicted in a pumping mode, according to the present disclosure.
Figure 22:
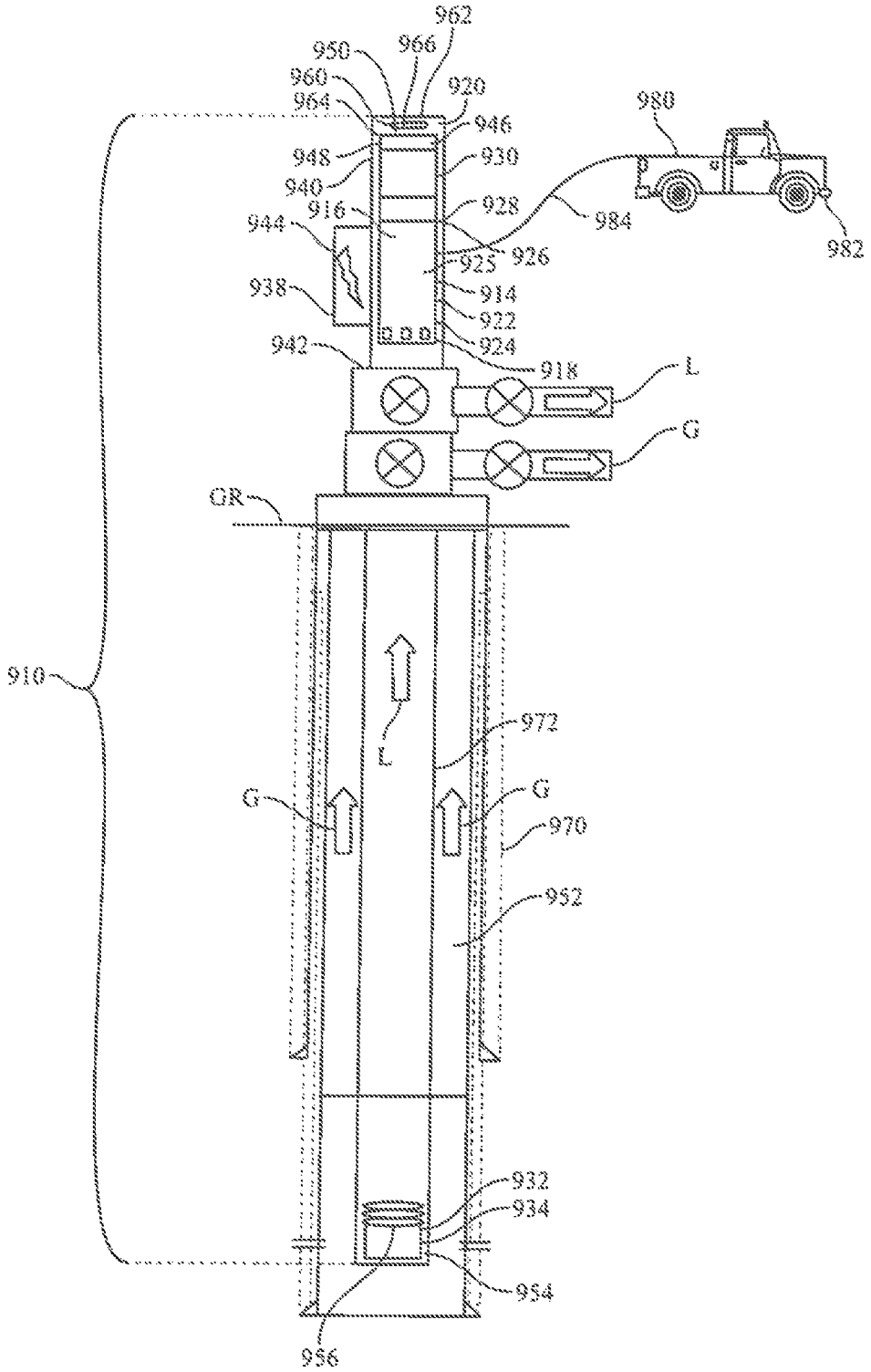
FIG. 22 presents a schematic view of an illustrative, nonexclusive example of the system for removing fluids from a subterranean well of FIG. 21, wherein the system is placed in the charging mode, according to the present disclosure.

Referring now to FIGS. 21-22, illustrated is another embodiment of a system 910 for removing fluids L from a subterranean well 912. The system 910 includes a housing 914, the housing 914 including a hollow cylindrical body 916, the hollow cylindrical body 916 having a first end 918 and a second end 920. The system 910 includes a positive-displacement solid state pump 922 for removing fluids from the subterranean well 912, the pump 922 positioned within the hollow cylindrical body 916. Pump 922 includes an inlet end 924 and a discharge end 926.

System 910 also includes a telemetry section 928. As shown in FIGS. 21-22, the telemetry section 928 is positioned within the hollow cylindrical body 916. To power positive-displacement solid state pump 922, a rechargeable battery 930 may be provided. In some embodiments, the rechargeable battery 930 may be positioned within the hollow cylindrical body 916. Rechargeable batteries having utility will be discussed in more detail below.

System 910 also includes an apparatus for releasably securing and sealing the housing 914. As shown, in some embodiments, the apparatus 932 may be positioned within a tubular 972 of the subterranean well 912. In some embodiments, the apparatus 932 may be a docking station 934, as shown, which forms a mechanical connection with the first end 918 of the hollow cylindrical body 916. In some embodiments, apparatus 932 may be in the form of a packer (not shown). In some embodiments, apparatus 932 may be a portion of the housing 914, itself. Other forms of apparatus 932 may have utility herein, providing they meet the requirements of securing the housing 914 and sealing the first end 918 of the hollow cylindrical body 916. In some embodiments, the apparatus 932 may include a latching bumper spring 956.

In some embodiments, the system 910 may include a battery recharging station 938 In some embodiments, the battery recharging station 938 may be positioned aboveground G, as shown in FIGS. 21-22. In some embodiments, battery recharging station 938 includes a receiver 940, which is structured and arranged to receive the housing 914 when the housing 914 is disengaged from the apparatus 932. In some embodiments, receiver 940 of battery recharging station 938 has an opening 942 at one end thereof, the opening 942 in communication with the tubular 972. As shown in FIG. 22, in some embodiments, the housing 914 is disengaged from the apparatus 932, transferred through the tubular 972 to the receiver 940 of battery recharging station 938 for charging. When positioned within the receiver 940, an electrical connection may be made with charger 944 and the rechargeable battery 930 is then charged.

In some embodiments, the system 910 may include a mobile charging unit 980 for charging the rechargeable battery 930 via cabling 984. In some embodiments, the mobile charging unit 980 may be installed in a vehicle 982, for convenience.

In some embodiments, the system 910 may include at least one sensor 946 for monitoring system conditions including the level of charge of the rechargeable battery 930. In some embodiments, the system 910 may include a communications system 948 for transmitting data obtained from the at least one sensor 946. In some embodiments, the communications system 948 transmits performance information to a supervisory control and data acquisition (SCADA) system (not shown).

Referring to FIG. 21, in some embodiments, the rechargeable battery 930 can be recharged via a downhole wet-mate connection 990 attached to wireline having multiple electrical conductors, or a slickline 992, with a larger power-source battery (not shown), attached to the wet-mate.

As may be appreciated by those skilled in the art, a slickline is a single-strand wire used to run tools into a wellbore. Slicklines can come in varying lengths, according to the depth of the wells in the area. It may be connected to a wireline sheave, which is a round wheel grooved and sized to accept a specified line and positioned to redirect the line to another sheave that will allow it to enter the wellbore while keeping the pressure contained.

The slickline power-source battery may be transported to the subterranean well 912 on a temporary basis, or remain on or near location, and be passively charged via renewable sources such as solar or wind, or fuel cells, hydrocarbon-fueled generators, etc.

In some embodiments, the wireline or slickline 992, or the power required for recharging, can be supplied by a mobile cable spooling and charging unit (not shown). This mobile spooling and charging unit can eliminate the requirement for permanent onsite power generation, as the unit could recharge rechargeable battery 930 of pump 922 while the pump 922 was in-place at its pumping position in the subterranean well 912, eliminating the need to wait for the pump 922 to return. The charging unit could use many different methods to produce electricity including, but not limited to, natural gas diesel generators, renewable sources, or fuel cells.

Referring again to FIGS. 21-22, in some embodiments, the system 910 may include a surfacing system 950 for raising the housing 914 to a position within the battery recharging station 938 when the housing 914 is disengaged from the apparatus 936.

In some embodiments, the housing 914 may be disengaged from the apparatus 932 in response to a signal received from the at least one sensor 946 that the rechargeable battery 930 has reached a predetermined level of discharge.

In some embodiments, the at least one sensor 946 for monitoring system conditions includes a sensor for monitoring downhole pressure 960, and a sensor for monitoring downhole temperature 962. In some embodiments, the downhole pressure sensor 960 provides a signal to a pump-off controller 64. In some embodiments, the at least one sensor 946 provides a signal to the pump 922 to change its operating speed to maintain an optimal fluid level above the pump.

In some embodiments, the surfacing system 950 is structured and arranged to raise and lower the density of the housing 914. In some embodiments, the surfacing system 950 comprises a buoyancy system. In some embodiments, the surfacing system 950 comprises a propeller system 966 or a jetting device (not shown).

In some embodiments, the subterranean well 912 further includes a casing 970, the tubular 972 positioned within the casing 970 to form an annulus 952 for producing gas G therethrough, with liquids L removed by the pump 922 through the tubular 972. In some embodiments, a standing valve 954 may be provided, the standing valve 954 positioned within the tubular 972 to retain liquids within the tubular 972.

In some embodiments, the battery for powering the driver 928 may be a rechargeable battery 930.

As is known by those skilled in the art, lithium-ion batteries belong to the family of rechargeable batteries in which lithium ions move from the negative electrode to the positive electrode during discharge and back when charging. Li-ion batteries use an intercalated lithium compound as one electrode material, compared to the metallic lithium used in a non-rechargeable lithium battery. The electrolyte, which allows for ionic movement, and the two electrodes are the consistent components of a lithium-ion cell.

Lithium-ion batteries are one of the most popular types of rechargeable batteries for portable electronics, having a high energy density, no memory effect, and only a slow loss of charge when not in use. Besides consumer electronics, lithium-ion batteries are used by the military, electric vehicle and aerospace industries. Chemistry, performance, cost and safety characteristics vary across lithium-ion battery types. Consumer electronics typically employ lithium cobalt oxide ($LiCoO_2$), which offers high energy density. Lithium iron phosphate (LFP), lithium manganese oxide (LMO) and lithium nickel manganese cobalt oxide (NMC) offer lower energy density, but longer lives and inherent safety. Such batteries are widely used for electric tools, medical equipment and other roles. NMC in particular is a leading contender for automotive applications. Lithium nickel cobalt aluminum oxide (NCA) and lithium titanate (LTO) are additional specialty designs.

Lithium-ion batteries typically have a specific energy density range of: 100 to 250 Wh/kg (360 to 900 kJ/kg); a volumetric energy density range of: 250 to 620 Wh/L (900 to 1900 J/cm$^3$); and a specific power density range of: 300 to 1500 W/kg at 20 seconds and 285 Wh/l).

With regard to lithium/air batteries, those skilled in the art recognize that the lithium/air couple has a theoretical energy density that is close to the limit of what is possible for a battery (~10,000 Wh/kg). Recent advances directed to a protected lithium electrode (PLE) has moved the lithium/air battery closer to commercial reality. Primary Li/Air technology has achieved specific energies in excess of 700 Wh/kg. Rechargeable Li/Air technology is expected to achieve much higher energy densities than commercial Li-ion chemistry, since in a lithium/air battery, oxygen is utilized from the ambient atmosphere, as needed for the cell reaction, resulting in a safe, high specific energy means for powering the solid state pump.

The natural abundance, large gravimetric capacity (~1600 mAh/g) and low cost of sulfur makes it an attractive positive electrode for advanced lithium batteries. With an average voltage of about 2 V, the theoretical energy density of the Li—S couple is about 2600 Wh/l and 2500 Wh/kg. The electrochemistry of the Li—S battery is distinguished by the presence of soluble polysulfides species, allowing for high power density and a natural overcharge protection mechanism. The high specific energy of the Li—S battery is particularly attractive for applications where battery weight is a critical factor in system performance.

Lithium/seawater batteries have recently gained attention. While lithium metal is not directly compatible with water, the high gravimetric capacity of lithium metal, 3800 mA/g, and its highly negative standard electrode potential, Eo=−3.045 V, make it extremely attractive when combined as an electrochemical couple with oxygen or water. At a nominal potential of about 3 volts, the theoretical specific energy for a lithium/air battery is over 5000 Wh/kg for the reaction forming LiOH ($Li+\frac{1}{4}O_2+\frac{1}{2}H_2O=LiOH$) and 11,000 Wh/kg for the reaction forming $Li_2O_2$ ($Li+O_2=Li_2O_2$) or for the reaction of lithium with seawater, rivaling the energy density for hydrocarbon fuel cells and far exceeding Li-ion battery chemistry that has a theoretical specific energy of about 400 Wh/kg. The use of a protected lithium electrode (PLE) makes lithium metal electrodes compatible with aqueous and aggressive non-aqueous electrolytes. Aqueous lithium batteries may have cell voltages similar to those of conventional Li-ion or lithium primary batteries, but with much higher energy density (for $H_2O$ or $O_2$ cathodes).

The University of Tokyo experimental battery uses the oxidation-reduction reaction between oxide ions and peroxide ions at the positive electrode. Peroxides are generated and dispersed due to charge and discharge reactions by using a material made by adding cobalt (Co) to the crystal structure of lithium oxide ($Li_2O$) for the positive electrode. The University of Tokyo experimental battery can realize an energy density seven times higher than that of existing lithium-ion rechargeable batteries.

The oxidation-reduction reaction between $Li_2O$ and $Li_2O_2$ (lithium peroxide) and oxidation-reduction reaction of metal Li are used at the positive and negative electrodes, respectively. The battery has a theoretical capacity of 897 mAh per 1 g of the positive/negative electrode active material, a voltage of 2.87 V and a theoretical energy density of 2,570 Wh/kg.

The energy density is 370 Wh per 1 kg of the positive/negative electrode active material, which is about seven times higher than that of existing Li-ion rechargeable batteries using $LiCoO_2$ positive electrodes and graphite negative electrodes. The theoretical energy density of the University of Tokyo battery is lower than that of lithium-air batteries (3,460 Wh/kg).

In some embodiments, the rechargeable battery 930 is selected from lithium-ion, lithium-air, lithium-seawater, or an engineered combination of battery chemistries. In some embodiments, the rechargeable battery 930 comprises a plurality of individual batteries.

Figure 23:
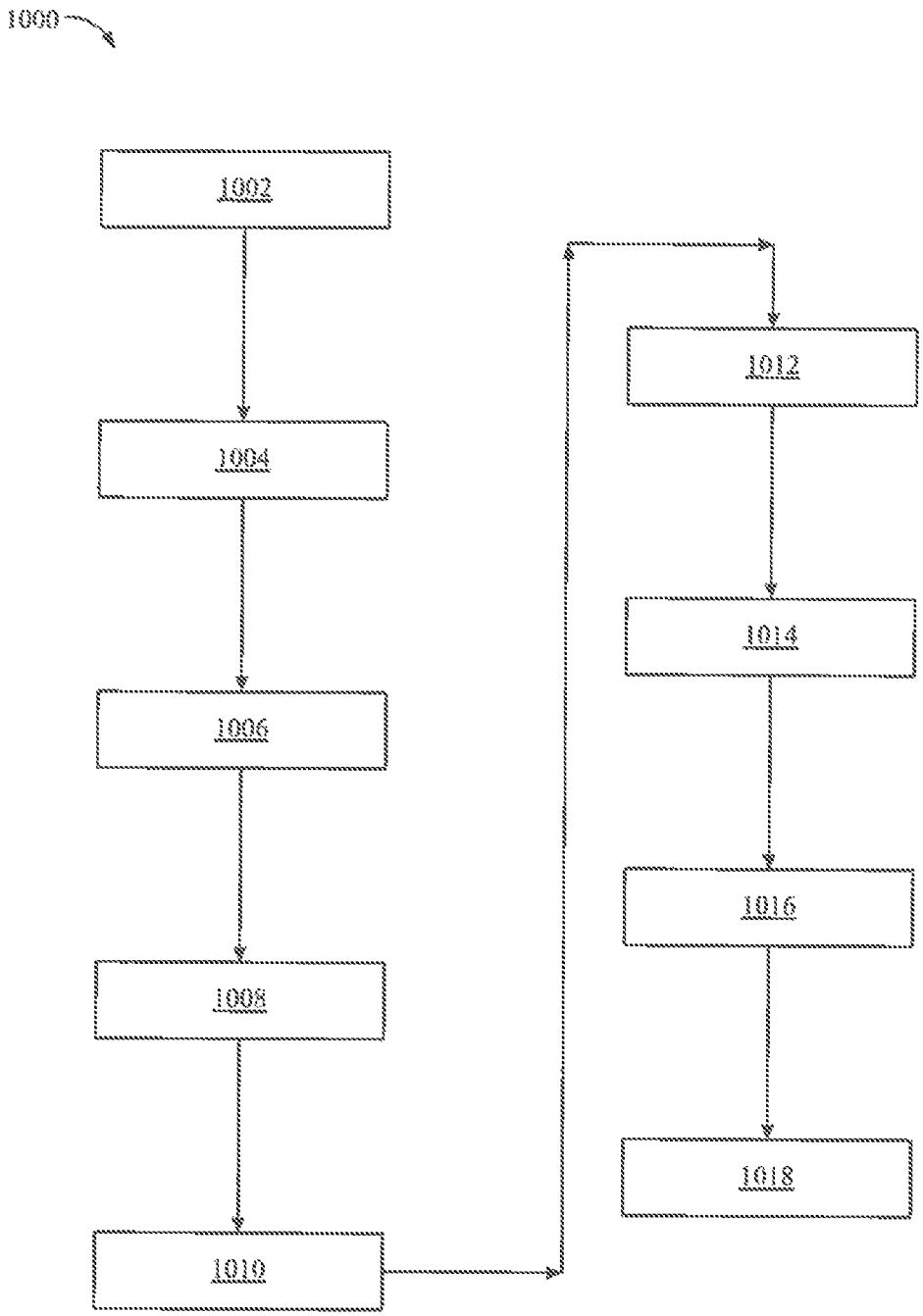
FIG. 23 is a flowchart depicting methods according to the present disclosure of removing a wellbore liquid from a wellbore.

Referring now to FIG. 23, a method of removing wellbore liquid from a wellbore 1000, the wellbore traversing a subterranean formation and having a tubular that extends within at least a portion of the wellbore is presented. The method 1000 includes the steps of 1002, electrically powering a downhole positive-displacement solid state pump comprising a fluid chamber, an inlet and an outlet port, each in fluid communication with the fluid chamber, at least one solid state actuator, a first one-way check valve positioned between the inlet port and the fluid chamber, and a second one-way check valve positioned between the outlet port and the fluid chamber, the at least one solid state actuator configured to operate at or near its resonance frequency, the solid state pump positioned within the wellbore; and 1004 pumping the wellbore liquid from the wellbore with the downhole positive-displacement solid state pump, wherein the pumping includes: (i) pressurizing the wellbore liquid with the downhole positive-displacement solid state pump to generate a pressurized wellbore liquid at a discharge pressure; and (ii) flowing the pressurized wellbore liquid at least a threshold vertical distance to a surface region.

In some embodiments, the method 1000 includes the step of 1006, positioning a profile seating nipple within the tubular for receiving the solid state pump, the profile seating nipple having a locking groove structured and arranged to matingly engage the solid state pump.

In some embodiments, the method 1000 includes the step of 1008, positioning a well screen or filter in fluid communication with the inlet end of the solid state pump, the well screen or filter having an inlet end and an outlet end; and a velocity fuse or standing valve positioned between the outlet end of the well screen or filter and the inlet end of the solid state pump.

In some embodiments, the method 1000 includes the step of 1010, reducing the force required to pull the positive-displacement solid state pump from the tubular by using an apparatus comprising a tubular sealing device for mating with the positive-displacement solid state pump, the tubular sealing device having an axial length and a longitudinal bore therethrough; and an elongated rod slidably positionable within the longitudinal bore of the tubular sealing device, the elongated rod having an axial flow passage extending therethrough, a first end, a second end, and an outer surface, the outer surface structured and arranged to provide a hydraulic seal when the elongated rod is in a first position within the longitudinal bore of the tubular sealing device, and at least one external flow port for pressure equalization upstream and downstream of the tubular sealing device when the elongated rod is placed in a second position within the longitudinal bore of the tubular sealing device, wherein the tubular sealing device is structured and arranged for landing within a nipple profile or for attaching to a collar stop for landing directly within the tubular.

In some embodiments, the method 1000 includes the step of 1012 forming a pump assembly by adding at least one secondary pump for transferring the wellbore liquids from the wellbore, wherein the inlet and outlet ports of the positive-displacement solid state pump are operatively connected to a hydraulic system to drive the at least one secondary pump.

In some embodiments, the method 1000 includes the step of 1014, reducing the force required to pull the pump assembly from the tubular by using an apparatus comprising a tubular sealing device for mating with the pump assembly, the tubular sealing device having an axial length and a longitudinal bore therethrough; and an elongated rod slidably positionable within the longitudinal bore of the tubular sealing device, the elongated rod having an axial flow passage extending therethrough, a first end, a second end, and an outer surface, the outer surface structured and arranged to provide a hydraulic seal when the elongated rod is in a first position within the longitudinal bore of the tubular sealing device, and at least one external flow port for pressure equalization upstream and downstream of the tubular sealing device when the elongated rod is placed in a second position within the longitudinal bore of the tubular sealing device, wherein the tubular sealing device is structured and arranged for landing within a nipple profile or for attaching to a collar stop for landing directly within the tubular.

In some embodiments, the method 1000 includes the step of 1016, a positioning a profile seating nipple within the tubular for receiving the pump assembly, the profile seating nipple having a locking groove structured and arranged to matingly engage the pump assembly.

In some embodiments, the method 1000 includes the step of 1018, positioning a well screen or filter in fluid communication with the inlet end of the pump assembly, the well screen or filter having an inlet end and an outlet end; and a velocity fuse or standing valve positioned between the outlet end of the well screen or filter and the inlet end of the pump assembly.

In some embodiments, the first one-way check valve and/or the second one-way check valve are passive one-way disk valves, active one-way disk valves, passive microvalve arrays, active microvalve arrays, passive MEMS valve arrays, active MEMS valve arrays or a combination thereof.

In some embodiments, the at least one solid state actuator is selected from piezoelectric, electrostrictive and/or magnetorestrictive actuators. In some embodiments, the at least one solid state actuator comprise a ceramic perovskite material. In some embodiments, the ceramic perovskite material comprises lead zirconate titanate and/or lead magnesium niobate. In some embodiments, the at least one solid state actuator comprise terbium dysprosium iron.

In some embodiments, the solid state pump further comprises a piston and a cylinder for housing the at least one solid state actuator and the first and second one-way check valves, so as to form a piston pump.

In some embodiments, the solid state pump further comprises a diaphragm operatively associated with the at least one solid state actuator and the first and second one-way check valves, so as to form a diaphragm pump.

In some embodiments, the step of electrically powering the solid state pump comprises using a power cable, the power cable operable for deploying the solid state pump. In some embodiments, the power cable comprises a synthetic conductor. In some embodiments, the step of electrically powering the solid state pump comprises using a rechargeable battery.

In some embodiments, the positive-displacement solid state pump is plugged into a downhole wet-mate connection and the step of electrically powering the solid state pump comprises using a power cable positioned on the outside of the tubular.

In some embodiments, the velocity fuse is structured and arranged to back-flush the well screen or filter and maintain a column of fluid within the tubular in response to an increase in pressure drop across the velocity fuse.

In some embodiments, the at least one secondary pump is a bladder pump, a centrifugal pump, a rotary screw pump, a rotary lobe pump, a gerotor pump, and/or a progressive cavity pump. In some embodiments, the bladder pump is a metal bellows pump or an elastomer pump.

In some embodiments, the velocity fuse is structured and arranged to back-flush the well screen or filter and maintain a column of fluid within the tubular in response to an increase in pressure drop across the velocity fuse.

In some embodiments, the apparatus is structured and arranged to be installed and retrieved from the tubular by a wireline or a coiled tubing.

In some embodiments, the method further includes detecting a downhole process parameter. In some embodiments, the downhole process parameter includes at least one of a downhole temperature, a downhole pressure, the discharge pressure, system vibration, a downhole flow rate, and the discharge flow rate.

Illustrative, non-exclusive examples of assemblies, systems and methods according to the present disclosure have been provided. It is within the scope of the present disclosure that an individual step of a method recited herein, including in the following enumerated paragraphs, may additionally or alternatively be referred to as a "step for" performing the recited action.

INDUSTRIAL APPLICABILITY

The apparatus and methods disclosed herein are applicable to the oil and gas industry.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

While the present invention has been described and illustrated by reference to particular embodiments, those of ordinary skill in the art will appreciate that the invention lends itself to variations not necessarily illustrated herein. For this reason, then, reference should be made solely to the appended claims for purposes of determining the true scope of the present invention.

The invention claimed is:

1. A system for removing wellbore liquids from a wellbore, the wellbore traversing a subterranean formation and having a tubular that extends within at least a portion of the wellbore, the system comprising:

a positive-displacement solid state pump comprising a fluid chamber, an inlet and an outlet port, each in fluid communication with the fluid chamber, at least one solid state actuator, a first one-way check valve positioned between the inlet port and the fluid chamber, and/or a second one-way check valve positioned between the outlet port and the fluid chamber, the at least one solid state actuator configured to operate at or near its resonance frequency, the solid state pump positioned within the wellbore;

means for powering the solid state pump;

a well screen or filter in fluid communication with the inlet end of the solid state pump, the well screen or filter having an inlet end and an outlet end; and a velocity fuse or standing valve positioned between the outlet end of the well screen or filter and the inlet end of the solid state pump;

wherein the velocity fuse is structured and arranged to back-flush the well screen or filter and maintain a column of fluid within the tubular in response to an increase in pressure drop across the velocity fuse.

2. The system of claim 1, wherein the at least one solid state actuator is selected from piezoelectric, electrostrictive and/or magnetorestrictive actuators.

3. The system of claim 2, wherein the at least one solid state actuator comprise a ceramic perovskite material.

4. The system of claim 3, wherein the ceramic perovskite material comprises lead zirconate titanate and/or lead magnesium niobate.

5. The system of claim 2, wherein the at least one solid state actuator comprise terbium dysprosium iron.

6. The system of claim 1, wherein the first one-way check valve and/or the second one-way check valve are passive one-way disk valves, active one-way disk valves, passive microvalve arrays, active microvalve arrays, passive MEMS valve arrays, active MEMS valve arrays, or a combination thereof.

7. The system of claim 1, wherein the solid state pump further comprises a piston and a cylinder for housing the at least one solid state actuator and the first and/or second one-way check valves, so as to form a piston pump.

8. The system of claim 1, wherein the solid state pump further comprises a diaphragm operatively associated with the at least one solid state actuator and the first and/or second the one-way check valves, so as to form a diaphragm pump.

9. The system of claim 1, wherein the means for powering the solid state pump is a power cable, the power cable operable for deploying the solid state pump.

10. The system of claim 9, wherein the power cable comprises a synthetic conductor.

11. The system of claim 1, wherein the means for powering the solid state pump is a rechargeable battery.

12. The system of claim 1, wherein the positive-displacement solid state pump is plugged into a downhole wet-mate connection and the means for powering the solid state pump is a power cable positioned on the outside of the tubular.

13. The system of claim 1, further comprising a profile seating nipple positioned within the tubular for receiving the solid state pump, the profile seating nipple having a locking groove structured and arranged to matingly engage the solid state pump.

14. The system of claim 1, further comprising an apparatus for reducing the force required to pull the positive-displacement solid state pump from the tubular, the apparatus comprising a tubular sealing device for mating with a downhole tubular component, the tubular sealing device having an axial length and a longitudinal bore therethrough; and an elongated rod slidably positionable within the longitudinal bore of the tubular sealing device, the elongated rod having an axial flow passage extending therethrough, a first end, a second end, and an outer surface, the outer surface structured and arranged to provide a hydraulic seal when the elongated rod is in a first position within the longitudinal bore of the tubular sealing device, and at least one external flow port for pressure equalization upstream and downstream of the tubular sealing device when the elongated rod is placed in a second position within the longitudinal bore of the tubular sealing device, wherein the tubular sealing device is structured and arranged for landing within a nipple profile or for attaching to a collar stop for landing directly within the tubular.

15. The system of claim 1, further comprising at least one secondary pump for transferring the wellbore liquids from the wellbore, wherein the inlet and outlet ports of the positive-displacement solid state pump are operatively connected to a hydraulic system to drive the at least one secondary pump and form a pump assembly.

16. The system of claim 15, wherein the at least one secondary pump is a bladder pump, a centrifugal pump, a rotary screw pump, a rotary lobe pump, a gerotor pump, and/or a progressive cavity pump.

17. The system of claim 15, wherein the bladder pump is a metal bellows pump or an elastomer pump.

18. The system of claim 15, a profile seating nipple positioned within the tubular for receiving the pump assembly, the profile seating nipple having a locking groove structured and arranged to matingly engage the solid state pump.

19. The system of claim 15, further comprising a well screen or filter in fluid communication with the inlet end of the pump, the well screen or filter having an inlet end and an outlet end; and a velocity fuse or standing valve positioned between the outlet end of the well screen or filter and the inlet end of the pump.

20. The system of claim 19, wherein the velocity fuse is structured and arranged to back-flush the well screen or filter and maintain a column of fluid within the tubular in response to an increase in pressure drop across the velocity fuse.

21. The system of claim 15, further comprising an apparatus for reducing the force required to pull the positive-displacement solid state pump from the tubular, the apparatus comprising a tubular sealing device for mating with the positive-displacement solid state pump, the tubular sealing device having an axial length and a longitudinal bore therethrough; and an elongated rod slidably positionable within the longitudinal bore of the tubular sealing device, the elongated rod having an axial flow passage extending therethrough, a first end, a second end, and an outer surface, the outer surface structured and arranged to provide a hydraulic seal when the elongated rod is in a first position within the longitudinal bore of the tubular sealing device, and at least one external flow port for pressure equalization upstream and downstream of the tubular sealing device when the elongated rod is placed in a second position within the longitudinal bore of the tubular sealing device, wherein the tubular sealing device is structured and arranged for landing within a nipple profile or for attaching to a collar stop for landing directly within the tubular.

22. The system of claim 21, wherein the apparatus is structured and arranged to be installed and retrieved from the tubular by a wireline or a coiled tubing.

23. A method of removing wellbore liquid from a wellbore, the wellbore traversing a subterranean formation and having a tubular that extends within at least a portion of the wellbore, the method comprising:

electrically powering a downhole positive-displacement solid state pump comprising a fluid chamber, an inlet and an outlet port, each in fluid communication with the fluid chamber, at least one solid state actuator, a first one-way check valve positioned between the inlet port and the fluid chamber, and a second one-way check valve positioned between the outlet port and the fluid chamber, the at least one solid state actuator configured to operate at or near its resonance frequency, the solid state pump positioned within the wellbore;

positioning a well screen or filter in fluid communication with the inlet end of the solid state pump, the well screen or filter having an inlet end and an outlet end; and a velocity fuse or standing valve positioned between the outlet end of the well screen or filter and the inlet end of the solid state pump, wherein the velocity fuse is structured and arranged to back-flush the well screen or filter and maintain a column of fluid within the tubular in response to an increase in pressure drop across the velocity fuse; and pumping the wellbore liquid from the wellbore with the downhole positive-displacement solid state pump, wherein the pumping includes:

(i) pressurizing the wellbore liquid with the downhole positive-displacement solid state pump to generate a pressurized wellbore liquid at a discharge pressure; and (ii) flowing the pressurized wellbore liquid at least a threshold vertical distance to a surface region.

24. The method of claim 23, wherein the first one-way active check valve and/or the second one-way active check valve are passive one-way disk valves, active one-way disk valves, passive microvalve arrays, active microvalve arrays, passive MEMS valve arrays, active MEMS valve arrays, or a combination thereof.

25. The method of claim 23, wherein the at least one solid state actuator is selected from piezoelectric, electrostrictive and/or magnetorestrictive actuators.

26. The method of claim 25, wherein the at least one solid state actuator comprise a ceramic perovskite material.

27. The method of claim 26, wherein the ceramic perovskite material comprises lead zirconate titanate and/or lead magnesium niobate.

28. The method of claim 25, wherein the at least one solid state actuator comprise terbium dysprosium iron.

29. The method of claim 23, wherein the solid state pump further comprises a piston and a cylinder for housing the at least one solid state actuator and the first and/or second one-way check valves, so as to form a piston pump.

30. The method of claim 23, wherein the solid state pump further comprises a diaphragm operatively associated with the at least one solid state actuator and the first and/or second one-way check valves, so as to form a diaphragm pump.

31. The method of claim 23, wherein the step of electrically powering the solid state pump comprises using a power cable, the power cable operable for deploying the solid state pump.

32. The method of claim 31, wherein the power cable comprises a synthetic conductor.

33. The method of claim 23, wherein the step of electrically powering the solid state pump comprises using a rechargeable battery.

34. The method of claim 23, wherein the positive-displacement solid state pump is plugged into a downhole wet-mate connection and the step of electrically powering the solid state pump comprises using a power cable positioned on the outside of the tubular.

35. The method of claim 23, further comprising the step of positioning a profile seating nipple within the tubular for receiving the solid state pump, the profile seating nipple having a locking groove structured and arranged to matingly engage the solid state pump.

36. The method of claim 23, further comprising the step of reducing the force required to pull the positive-displacement solid state pump from the tubular by using an apparatus comprising a tubular sealing device for mating with the positive-displacement solid state pump, the tubular sealing device having an axial length and a longitudinal bore therethrough; and an elongated rod slidably positionable within the longitudinal bore of the tubular sealing device, the elongated rod having an axial flow passage extending therethrough, a first end, a second end, and an outer surface, the outer surface structured and arranged to provide a hydraulic seal when the elongated rod is in a first position within the longitudinal bore of the tubular sealing device, and at least one external flow port for pressure equalization upstream and downstream of the tubular sealing device when the elongated rod is placed in a second position within the longitudinal bore of the tubular sealing device, wherein the tubular sealing device is structured and arranged for landing within a nipple profile or for attaching to a collar stop for landing directly within the tubular.

37. The method of claim 23, further comprising the step of forming a pump assembly by adding at least one secondary pump for transferring the wellbore liquids from the wellbore, wherein the inlet and outlet ports of the positive-displacement solid state pump are operatively connected to a hydraulic system to drive the at least one secondary pump.

38. The method of claim 37, wherein the at least one secondary pump is a bladder pump, a centrifugal pump, a rotary screw pump, a rotary lobe pump, a gerotor pump, and/or a progressive cavity pump.

39. The method of claim 38, wherein the bladder pump is a metal bellows pump or an elastomer pump.

40. The method of claim 37, further comprising the step of a positioning a profile seating nipple within the tubular for receiving the pump assembly, the profile seating nipple having a locking groove structured and arranged to matingly engage the pump assembly.

41. The method of claim 37, further comprising the step of positioning a well screen or filter in fluid communication with the inlet end of the pump assembly, the well screen or filter having an inlet end and an outlet end; and a velocity fuse or standing valve positioned between the outlet end of the well screen or filter and the inlet end of the pump assembly.

42. The method of claim 41, wherein the velocity fuse is structured and arranged to back-flush the well screen or filter and maintain a column of fluid within the tubular in response to an increase in pressure drop across the velocity fuse.

43. The method of claim 37, further comprising the step of reducing the force required to pull the pump assembly from the tubular by using an apparatus comprising a tubular sealing device for mating with the pump assembly, the tubular sealing device having an axial length and a longitudinal bore therethrough; and an elongated rod slidably positionable within the longitudinal bore of the tubular sealing device, the elongated rod having an axial flow passage extending therethrough, a first end, a second end, and an outer surface, the outer surface structured and arranged to provide a hydraulic seal when the elongated rod is in a first position within the longitudinal bore of the tubular sealing device, and at least one external flow port for pressure equalization upstream and downstream of the tubular sealing device when the elongated rod is placed in a second position within the longitudinal bore of the tubular sealing device, wherein the tubular sealing device is structured and arranged for landing within a nipple profile or for attaching to a collar stop for landing directly within the tubular.

44. The system of claim 43, wherein the apparatus is structured and arranged to be installed and retrieved from the tubular by a wireline or a coiled tubing.

45. The method of claim 23, wherein the method further includes detecting a downhole process parameter.

46. The method of claim 45, wherein the downhole process parameter includes at least one of a downhole temperature, a downhole pressure, the discharge pressure, system vibration, a downhole flow rate, and the discharge flow rate.

* * * * *